US009283782B2

(12) United States Patent
Terada

(10) Patent No.: US 9,283,782 B2
(45) Date of Patent: Mar. 15, 2016

(54) RECORDING APPARATUS AND NON-TRANSITORY STORAGE MEDIUM STORING INSTRUCTIONS EXECUTABLE BY THE RECORDING APPARATUS

(71) Applicant: Brother Kogyo Kabushiki Kaisha, Nagoya-shi, Aichi-ken (JP)

(72) Inventor: Kohei Terada, Kiyosu (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/568,272

(22) Filed: Dec. 12, 2014

(65) Prior Publication Data

US 2015/0183240 A1 Jul. 2, 2015

(30) Foreign Application Priority Data

Dec. 27, 2013 (JP) ..... 2013-272838

(51) Int. Cl.

| | |
|---|---|
| ***B41J 29/38*** | (2006.01) |
| ***B41J 29/393*** | (2006.01) |
| ***B41J 2/015*** | (2006.01) |
| ***B41J 13/00*** | (2006.01) |
| ***B41J 3/54*** | (2006.01) |

(52) U.S. Cl.

CPC ..... *B41J 13/0009* (2013.01); *B41J 3/543* (2013.01); *B41J 13/009* (2013.01)

(58) Field of Classification Search

USPC ..... 347/16, 19–20

See application file for complete search history.

(56) References Cited

U.S. PATENT DOCUMENTS

| | | | | |
|---|---|---|---|---|
| 6,626,110 | B1 * | 9/2003 | Keller | 101/485 |
| 7,188,929 | B2 * | 3/2007 | Lofthus | 347/40 |
| 2002/0036668 | A1 * | 3/2002 | Matsumoto et al. | 347/19 |
| 2014/0292973 | A1 | 10/2014 | Terada | |

FOREIGN PATENT DOCUMENTS

| | | |
|---|---|---|
| JP | 2003-305893 | 10/2003 |
| JP | 2005-053016 | 3/2005 |

* cited by examiner

*Primary Examiner* — Jason Uhlenhake

(74) *Attorney, Agent, or Firm* — Frommer Lawrence & Haug LLP

(57) ABSTRACT

A recording apparatus includes: recording modules for conveying a recording medium along a first conveyance path and including a recording device; a storage tray storing a recording medium; at least one first output tray; a second conveyance path connecting between the storage tray and one end portion of each of the recording modules; a third conveyance path connecting between the second conveyance path and the other end portion of each of the recording modules; and at least one fourth conveyance path each connecting between the other end portion and a corresponding one of the at least one first output tray. One recording medium on which all of at least one image has been recorded by a recording device is discharged onto the at least one first output tray via the third conveyance path, the second conveyance path, the recording module, and the fourth conveyance path.

11 Claims, 13 Drawing Sheets

RECORDING APPARATUS AND NON-TRANSITORY STORAGE MEDIUM STORING INSTRUCTIONS EXECUTABLE BY THE RECORDING APPARATUS

CROSS REFERENCE TO RELATED APPLICATION

The present application claims priority from Japanese Patent Application No. 2013-272838, which was filed on Dec. 27, 2013, the disclosure of which is herein incorporated by reference in its entirety.

BACKGROUND

1. Technical Field

The present invention relates to a recording apparatus configured to record an image and a non-transitory storage medium storing a plurality of instructions executable by a processor of the recording apparatus.

2. Description of the Related Art

In order to perform image recording on many sheets, there is known an inkjet recording apparatus including a plurality of recording units (i.e., recording modules) which can perform image recording at the same time to perform speedy printing. In the conventional inkjet recording apparatus, each of the recording units includes a recording head configured to eject ink from ejection openings onto a sheet to perform image recording. In each of the recording units, the sheet printed by the recording head is discharged from an output opening formed in each recording unit in a state in which an image-recorded surface of the sheet faces upward (noted that this discharge is what is called a face-up discharge).

SUMMARY

In the conventional inkjet recording apparatus, since the printed sheets are discharged onto an output tray in order in the state in which the image-recorded surface of each sheet faces upward, the page order of the printed sheets supported by the output tray is reverse to the order of recordings performed by the recording unit. In order to collate pages of the printed sheets, a user needs to rearrange the printed sheets in the right order, placing a heavy load on the user. Also, if the print data are rearranged in the reverse order and printed, the printed sheets are discharged in the right page order, but this rearrangement of the data requires a larger amount of memory and a longer time for printing.

This invention has been developed to provide: a recording apparatus capable of performing speedy image recording and discharging a recording medium onto an output tray in a state in which an image recorded surface of the recording medium faces downward; and a non-transitory storage medium storing a plurality of instructions executable by a processor of the recording apparatus.

The present invention provides a recording apparatus including: an image-data storage configured to store image data; a plurality of recording modules each including: a first conveyor configured to convey a recording medium along a first conveyance path; and a recording device configured to record an image on an upper surface of the recording medium; a storage tray configured to store a recording medium; at least one first output tray each configured to support a recording medium discharged from a corresponding one of at least one first recording module of the plurality of recording modules; a second conveyance path connecting between the storage tray and one end portion of the first conveyance path for each of the plurality of recording modules; a third conveyance path configured to connect between the second conveyance path and another end portion of the first conveyance path for each of the plurality of recording modules; at least one fourth conveyance path each connecting between said another end portion of the first conveyance path for a corresponding one of the at least one first recording module and a corresponding one of the at least one first output tray; a second conveyor configured to convey the recording medium along the second conveyance path; a first switcher configured to selectively switch a destination of conveyance of the recording medium conveyed to said another end portion of the first conveyance path, to any one of the third conveyance path and the at least one fourth conveyance path; a second switcher configured to selectively switch a destination of conveyance of the recording medium conveyed to the second conveyance path, to any one of the plurality of recording modules; a third conveyor configured to convey the recording medium along the third conveyance path; and a controller configured to control the plurality of recording modules, the first conveyor, the second conveyor, the third conveyor, the first switcher, and the second switcher. The controller is configured to control the plurality of recording modules, the first conveyor, the second conveyor, the third conveyor, the first switcher, and the second switcher such that one recording medium on which all of at least one image to be recorded on the one recording medium has been recorded by the recording device of at least one of the plurality of recording modules is discharged onto the at least one first output tray via the third conveyance path, the second conveyance path, one of the at least one first recording module, and one of the at least one fourth conveyance path.

The present invention also provides a non-transitory storage medium storing a plurality of instructions executable by a processor of a recording apparatus. The recording apparatus includes: an image-data storage configured to store image data; a plurality of recording modules each including: a first conveyor configured to convey a recording medium along a first conveyance path; and a recording device configured to record an image on an upper surface of the recording medium; a storage tray configured to store a recording medium; at least one first output tray each configured to support a recording medium discharged from a corresponding one of at least one first recording module of the plurality of recording modules; a second conveyance path connecting between the storage tray and one end portion of the first conveyance path for each of the plurality of recording modules; a third conveyance path configured to connect between the second conveyance path and another end portion of the first conveyance path for each of the plurality of recording modules; at least one fourth conveyance path each connecting between said another end portion of the first conveyance path for a corresponding one of the at least one first recording module and a corresponding one of the at least one first output tray; a second conveyor configured to convey the recording medium along the second conveyance path; a first switcher configured to selectively switch a destination of conveyance of the recording medium conveyed to said another end portion of the first conveyance path, to any one of the third conveyance path and the at least one fourth conveyance path; a second switcher configured to selectively switch a destination of conveyance of the recording medium conveyed to the second conveyance path, to any one of the plurality of recording modules; a third conveyor configured to convey the recording medium along the third conveyance path; and a controller configured to control the plurality of recording modules, the first conveyor, the second conveyor, the third conveyor, the first switcher, and the second switcher. The plurality of instructions, when executed by the processor, cause the recording apparatus to control the plurality of recording modules, the first conveyor, the second conveyor, the third conveyor, the first switcher, and the second switcher such that one recording medium on which all of at least one image to be recorded on the one recording medium has been recorded by the recording device of at least one of the plurality of recording modules is discharged onto the at least one first output tray via the third conveyance path, the second conveyance path, one of the at least one first recording module, and one of the at least one fourth conveyance path.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which.

DETAILED DESCRIPTION OF THE EMBODIMENT

Figure 1:
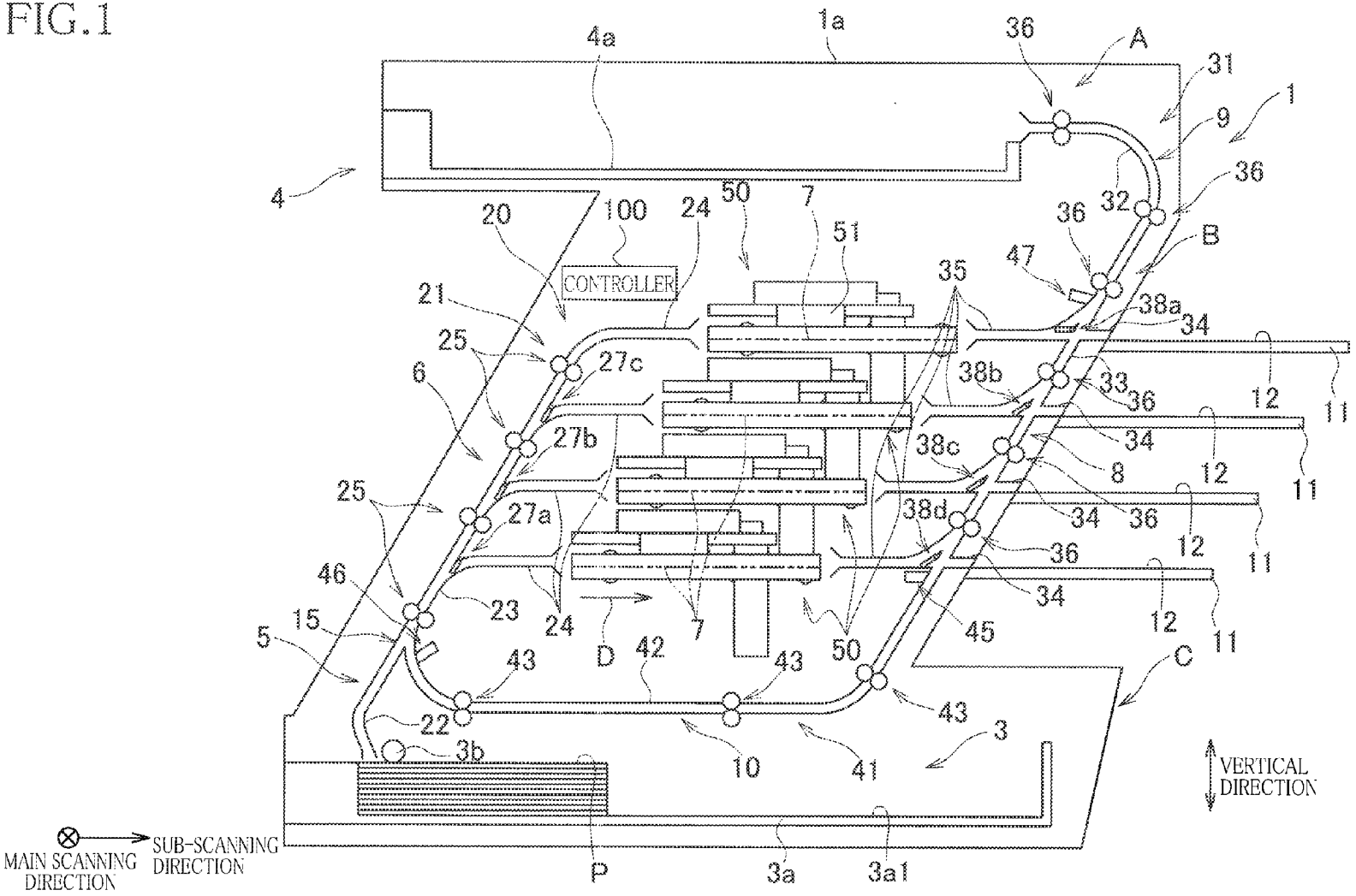
FIG. 1 is a schematic side view illustrating an internal structure of an inkjet printer as one example of a recording apparatus according to one embodiment of the present invention.

Hereinafter, there will be described one embodiment of the present invention by reference to the drawings. First, there will be explained, with reference to FIG. 1, an overall construction of an ink-jet printer 1 as one example of a recording apparatus according to one embodiment of the present invention.

The printer 1 includes a housing 1*a* having a Z-shape in cross section. The interior of the housing 1*a* can be divided into spaces A, B, C in order from above. A second output tray 4 and a downstream curved path 9 are provided in the space A. A sheet-supply unit 3 and an upstream curved path 5 are provided in the space C. The housing 1*a* is provided with four first output trays 11. Formed in the space B are an upstream conveyance path 6, four intermediate conveyance paths 7, and a downstream conveyance path 8 which extend from the sheet-supply unit 3 to the first output trays 11 and the second output tray 4. A re-conveyance path 10 is formed in the space B and the space C, and this re-conveyance path 10 extends from the downstream conveyance path 8 to the upstream conveyance path 6. A sheet P as one example of a recording medium supplied from the sheet-supply unit 3 is conveyed through the above-described paths and discharged to one of the four first output trays 11 or the second output tray 4. In the space B, image recording is performed on the sheet P on any one of the intermediate conveyance paths 7.

Devices provided in the space B include four recording modules 50, a conveying mechanism 20, and a controller 100. Each of the recording modules 50 includes a serial head 51 and the intermediate conveyance path 7 as one example of a first conveyance path. In the space B, four cartridges, not shown, are disposed. Each of these cartridges stores black ink. Each cartridge is connected to a corresponding one of the heads 51 via a tube and a pump, not shown, and the ink is supplied to the head 51. In the present embodiment, the monochrome head is employed, but a color head may be employed. In this case, some cartridges store color ink.

The conveying mechanism 20 includes an upstream guide unit 21, a downstream guide unit 31, and a re-conveyance guide unit 41. The upstream guide unit 21 includes guides 22, 23, four guides 24, four conveying roller pairs 25 (as one example of a second conveyor), and three switching mechanisms 27*a*-27*c*. This upstream guide unit 21 connects between the sheet-supply unit 3 and each of the recording modules 50. The four conveying roller pairs 25 are rotated by a conveying motor 25M (see FIG. 7) controlled by the controller 100 to convey the sheet P to a desired one of the recording modules 50.

The downstream guide unit 31 includes guides 32, 33, four guides 34, four guides 35, six conveying roller pairs 36, and four switching mechanisms 38*a*-38*d*. This downstream guide unit 31 connects between (i) each of the recording modules 50 and (ii) the second output tray 4 and a corresponding one of the four first output trays 11. The six conveying roller pairs 36 (each as one example of a portion of a third conveyor) are rotated by a conveying motor 36M (see FIG. 7) controlled by the controller 100 to convey the sheet P conveyed from the recording modules 50, to the downstream curved path 9 or the re-conveyance path 10.

The re-conveyance guide unit 41 includes a guide 42 and three conveying roller pairs 43 (each as one example of a portion of the third conveyor). This re-conveyance guide unit 41 connects between the upstream guide unit 21 and the downstream guide unit 31 not via the recording modules 50. The three conveying roller pairs 43 are rotated by a conveying motor 43M (see FIG. 7) controlled by the controller 100 to convey the sheet P to the upstream guide unit 21.

The sheet-supply unit 3 provided in the space C includes a sheet-supply tray 3*a* (as one example of a storage tray) and a sheet-supply roller 3*b*. The sheet-supply tray 3*a* is mountable and removable on and from the housing 1*a* in a sub-scanning direction. The sheet-supply tray 3*a* is shaped like a box opening upward and has a support surface 3*a*1 for supporting a plurality of sheets P thereon. In a state in which the sheet-supply tray 3*a* is mounted on the housing 1*a*, the sheet-supply tray 3*a*, overlaps all the recording modules 50 in a vertical direction. Also, in the state in which the sheet-supply tray 3*a* is mounted on the housing 1*a*, the sheet-supply tray 3*a* is disposed at a position at which the center or the sheet P supported on the support surface 3*a*1 is located at generally the same position in a main scanning direction as the center of the intermediate conveyance path 7 of each recording module 50. The sheet-supply roller 3*b* is rotated by a sheet-supply motor 3*b*M (see FIG. 7) controlled by the controller 100 to supply an uppermost one of the sheets P stored in the sheet-supply tray 3*a*, to the upstream curved path 5.

The second output tray 4 disposed in the space A is shaped like a box opening upward and has a support surface 4*a* for supporting a plurality of sheets P thereon. This second output tray 4 is shared by the four recording modules 50. Like the sheet-supply tray 3*a*, the second output tray 4 overlaps all the recording modules 50 in the vertical direction. Also, the second output tray 4 is disposed at a position at which the center or the sheet P supported on the support surface 4*a* is located at generally the same position in the main scanning direction as the center of the intermediate conveyance path 7 of each recording module 50.

As illustrated in FIG. 1, each of the four first output trays 11 is shaped like a plate having a support surface 12 for supporting the sheet P, and these four first output trays 11 are spaced uniformly in the vertical direction. These four first output trays 11 respectively correspond to the four recording modules 50, and each of the first output trays 11 is specific to the corresponding one of the recording modules 50. Each of the support surfaces 12 is generally parallel with the sub-scanning direction and can support the sheet P discharged from the corresponding one of the recording modules 50. In the present embodiment, each of all the four recording modules 50 corresponds to a first recording module.

Here, the sub-scanning direction is parallel with a sheet conveying direction D in which the sheet P is conveyed by conveying roller pairs 52-54 which will be described below, and the main scanning direction is parallel with a horizontal plane and perpendicular to the sub-scanning direction.

The controller 100 controls operations of the printer 1 by controlling operations of the devices and components of the printer 1. The controller 100 controls an image recording operation based on image data (i.e., a recording command) supplied from an external device 97 (see FIG. 7) such as a PC connected to the printer 1. Specifically, the controller 100 controls various operations including a sheet supply operation, a sheet conveyance operation, a sheet discharge operation, and an ink ejecting operation which is performed in synchronization with conveyance of the sheet P.

Figure 2:
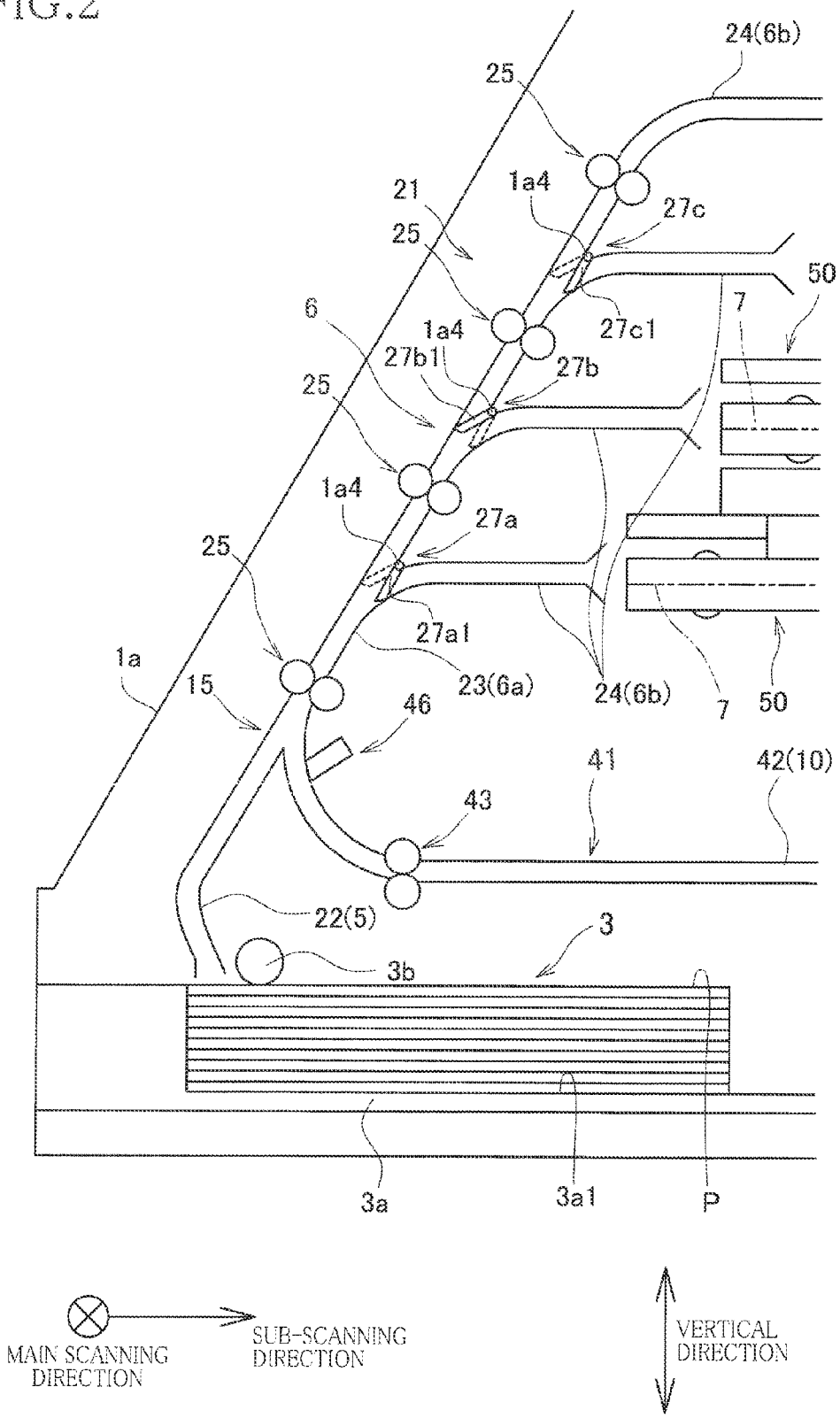
FIG. 2 is an enlarged view illustrating a main portion of the printer illustrated in FIG. 1.

There will be next explained the upstream guide unit 21 in detail with reference to FIG. 2. The guide 22 of the upstream guide unit 21 has a generally arc shape extending from the sheet-supply roller 3*b* to a lower end of the guide 23. That is, the upstream curved path 5 is defined by the guide 22 connecting between the sheet-supply unit 3 and the guide 23.

The upstream conveyance path 6 is defined by the guide 23 and the four guides 24 and includes an upstream first path 6*a* and the four upstream second paths 6*b*. The guide 23 extends obliquely rightward in FIG. 2 and defines the upstream first path 6*a*. The guide 23 is disposed at a position at which the guide 23 is partly opposed to all the recording modules 50 in the sub-scanning direction.

Each of the four guides 24 extends parallel with the sub-scanning direction in FIG. 2 and curves at its end portion so as to connect between the guide 23 and an upstream end of a corresponding one of the intermediate conveyance paths 7. That is, the four upstream second paths 6*b* extend in the sub-scanning direction and are defined by the respective guides 24 connecting between the guide 23 and the upstream ends of the respective intermediate conveyance paths 7. The four guides 24 are spaced uniformly in the vertical direction. An uppermost one of the four guides 24 is connected to an upper end of the guide 23. Each of the guides 24 (i.e., the upstream second paths 6*b*) and the corresponding one of the intermediate conveyance paths 7 are connected to each other in a straight line. In the present embodiment, the upstream curved path 5 and the upstream conveyance path 6 constitute a second conveyance path connecting between the sheet-supply tray 3*a* and the upstream ends of the intermediate conveyance paths 7 of the respective four recording modules 50.

Figure 7:
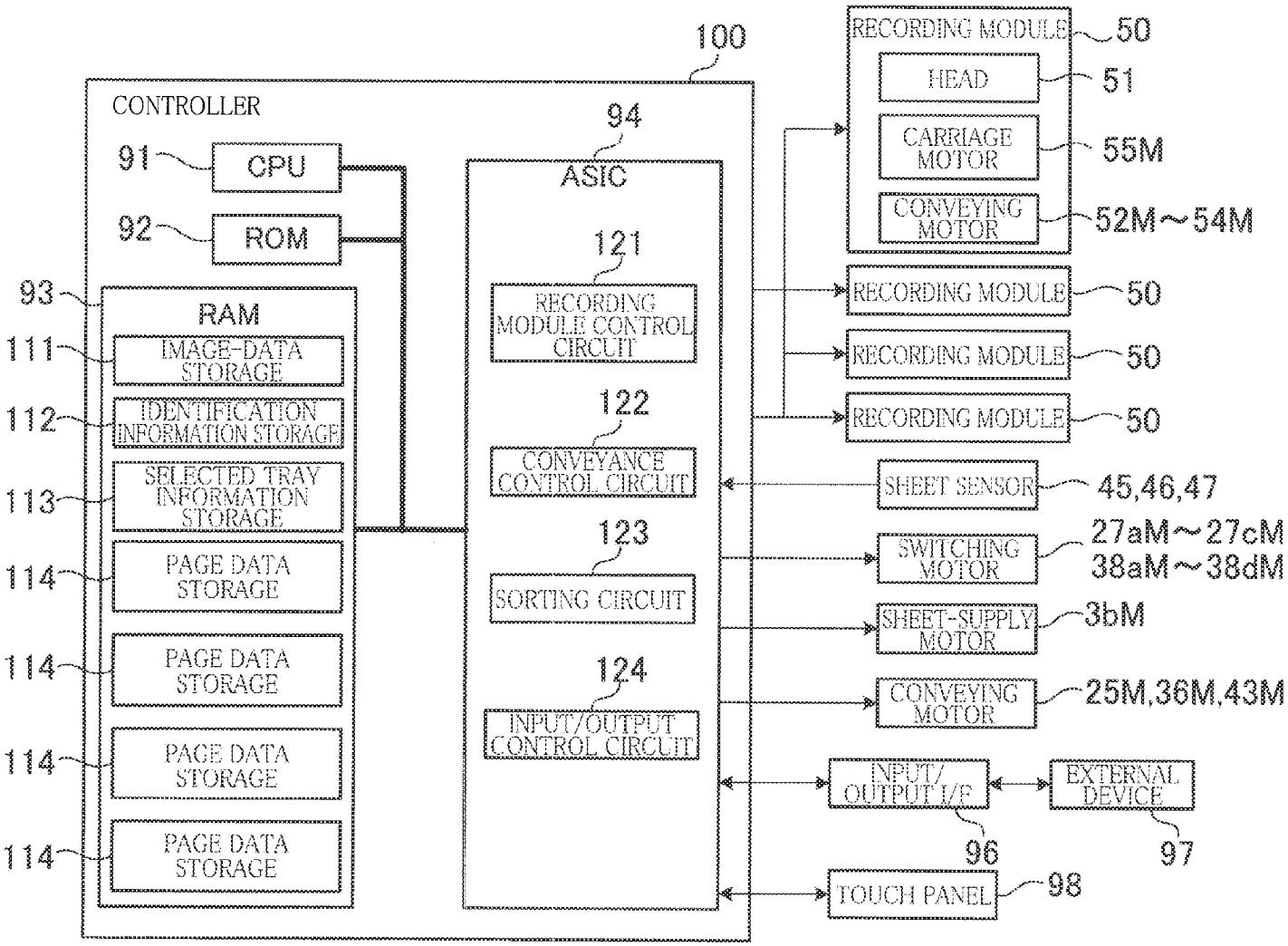
FIG. 7 is a block diagram illustrating an electric configuration of the printer.

The three switching mechanisms 27*a*-27*c* include respective switchers 27*a*1-27*c*1 and respective switching motors 27*a*M-27*c*M (see FIG. 7). Each of these switchers 27*a*1-27*c*1 is supported by a corresponding one of pins 1*a*4 formed in the housing 1*a* such that each switcher is pivotable. Each of the switchers 27*a*1-27*c*1 is driven by a corresponding one of the switching motors 27*a*M-27*c*M controlled by the controller 100 so as to be selectively positioned at one of a guiding position and an interrupting position. With each of the switchers 27*a*1-27*c*1 being located at the guiding position, a distal end of the switcher is held in contact with the guide 23. With each of the switchers 27*a*1-27*c*1 being located at the interrupting position, the distal end of the switcher is held in contact with the corresponding guide 24, so that the upstream first path 6*a* and a corresponding one of the upstream second paths 6*b* which is held in contact with the switcher are isolated from each other.

In the present embodiment, as illustrated in FIG. 1, when the sheet P is conveyed to the uppermost recording module 50, the controller 100 positions each of all the switchers 27*a*1-27*c*1 to the interrupting position. As a result, the upstream first path 6*a* communicates with the uppermost upstream second path 6*b* continuous to the intermediate conveyance path 7 of the uppermost recording module 50. When the sheet P is conveyed to the second recording module 50 from the top, as illustrated in FIG. 2, the controller 100 positions only the switcher 27*c*1 to the guiding position and positions each of the switchers 27*a*1-27*b*1 to the interrupting position. As a result, a portion of the upstream first path 6*a* which extends to the switcher 27*c*1 communicates with the upstream second path 6*b* continuous to the intermediate conveyance path 7 of the second recording module 50 from the top. When the sheet P is conveyed to the third recording module 50 from the top, the controller 100 positions only the switcher 27*b*1 to the guiding position and positions each of the switchers 27*a*1, 27*c*1 to the interrupting position. When the sheet P is conveyed to the lowermost recording module 50, the controller 100 positions only the switcher 27*a*1 to the guiding position and each of the switchers 27*b*1, 27*c*1 to the interrupting position. It is noted that when the sheet P is conveyed to the third recording module 50 from the top, the switcher 27*c*1 may be positioned at the guiding position, and when the sheet P is conveyed to the lowermost recording module 50, each of the switchers 27*b*1, 27*c*1 may be positioned at the guiding position. Though described below, since one end of the re-conveyance path 10 is connected to a joining point 15 at which the upstream curved path 5 and the upstream conveyance path 6 are joined together, the three switching mechanisms 27*a*-27*c* can switch a destination of the sheet P conveyed from the re-conveyance path 10 to the upstream conveyance path 6. In the present embodiment, each of the three switching mechanisms 27*a*-27*c* is one example of a second switcher configured to selectively switch a destination of the sheet P conveyed to the re-conveyance path 10 (as one example of a third conveyance path which will be described below), to any one of the four recording modules 50.

Figure 3:
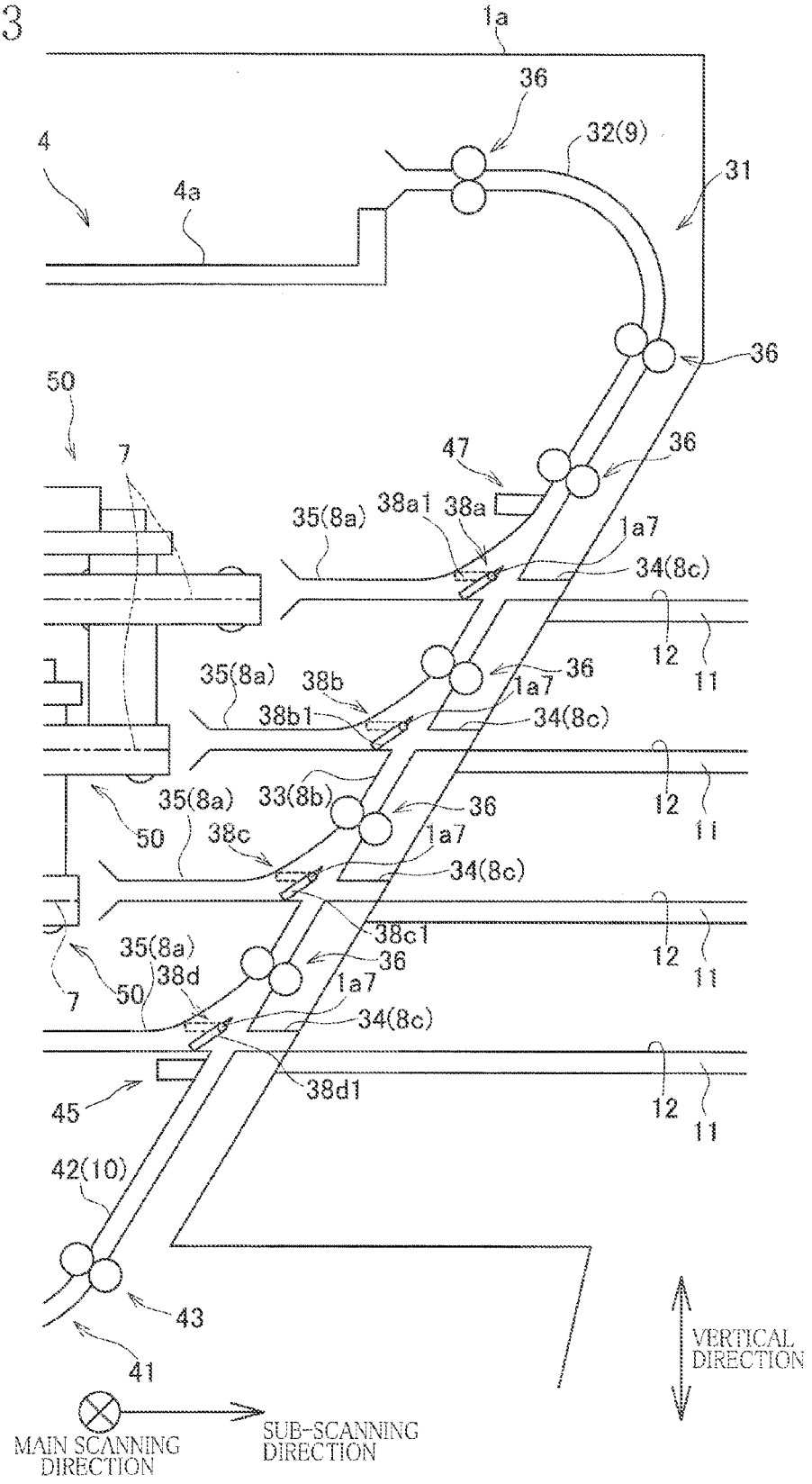
FIG. 3 is an enlarged view illustrating a main portion of the printer illustrated in FIG. 1.

There will be next explained the downstream guide unit 31 of the conveying mechanism 20 in detail with reference to FIG. 3. The guide 32 of the downstream guide unit 31 has a generally arc shape extending from an upper end of the guide 33 to the second output tray 4. That is, the downstream curved path 9 is defined by the guide 32 connecting between the second output tray 4 and the guide 33. At a lower end of the guide 32, a sheet sensor 47 is disposed for sensing the conveyed sheet P. When having sensed the sheet P, the sheet sensor 47 outputs a signal to the controller 100. When a state is switched, during conveyance of the sheet P through the position of the sheet sensor 47, from a state in which this signal is output to a state in which the signal is not output, this switch of the state means that a leading edge of the sheet P passes through the position of the sheet sensor. On the other hand, when the state is switched from the state in which the signal is not output to the state in which this signal is output, this switch of the state means that a trailing edge of the sheet P passes through the position of the sheet sensor. These kinds of information are processed by a conveyance control circuit 122 which will be described below but the following description uses simplified expressions such as an expression "when the sheet sensor has detected the trailing edge of the sheet". It is noted that the sheet sensor may be configured to output a signal when there is no sheet. Each of sheet sensors 45, 46 which will be described below has generally the same construction as the Sheet sensor 47.

The downstream conveyance path 8 is defined by the guide 33, the four guides 34, and the four guides 35 and includes four downstream first paths 8*a*, a downstream second path 8*b*, and four downstream third paths 8*c*. Each of the four guides 35 extends parallel with the sub-scanning direction in FIG. 3 and connects between the guide 33 and a downstream end of a corresponding one of the intermediate conveyance paths 7. That is, the for downstream first paths 8*a* extend in the sub-scanning direction and are defined by the respective guides 35 connecting between the guide 33 and the downstream ends of the respective intermediate conveyance paths 7. Like the guides 24, the four guides 35 are spaced uniformly in the vertical direction and disposed on an opposite side of the guide 33 from the guides 34. The uppermost one of the four guides 35 is connected to the upper end of the guide 33. The lowermost one of the four guides 35 is connected to a lower end of the guide 33.

The guide 33 extends obliquely rightward in FIG. 3 and defines the downstream second path 8*b*. That is like the upstream first path 6*a*, the downstream second path 8*b* extends in a direction intersecting the intermediate conveyance path 7 of each recording module 50. The guide 33 is disposed at a position at which the guide 33 is partly opposed to all the recording modules 50 in the sub-scanning direction. The four guides 34 extend parallel with the sub-scanning direction in FIG. 3 and connect between the respective guides 35 and the respective first output trays 11. That is, the four downstream third paths 8*c* extend in the sub-scanning direction and are respectively defined by the guides 34 connecting between the respective first output trays 11 and the respective guides 35. Also, the four guides 34 are disposed on an opposite side of the guide 33 from the recording modules 50.

Each of the guides 34 (i.e., the downstream third paths 8*c*) and a corresponding one of the support surfaces 12 of the respective first output trays 11 are connected to each other in a straight line. Likewise, each of the guides 35 (i.e., the downstream first paths 8*a*) and a corresponding one of the intermediate conveyance paths 7 are connected to each other in a straight line. Thus, when each sheet P conveyed from a corresponding one of the recording modules 50 is discharged to a corresponding one of the first output trays 11 via a corresponding one of the downstream first paths 8*a* and a corresponding one of the downstream third paths 8*c*, a surface of the sheet P which is a back side from an upper surface thereof at the point in time when the sheet P has last conveyed through the recording module 50 is supported on the support surface 12 of the corresponding first output tray 11. In other words, the downstream first paths 8*a* and the downstream third paths 8*c* connects between the respective intermediate conveyance paths 7 and the respective first output trays 11 such that the surface of the sheet P which is a back side from the upper surface thereof at the point in time when the sheet P has last conveyed through the recording module 50 is supported on the support surface 12 of a desired one of the first output trays 11. In the present embodiment, the downstream first paths 8*a* and the downstream third paths 8*c* constitute at least one fourth conveyance path.

The downstream second path 8*b* is connected to the respective intermediate conveyance paths 7 of all the recording modules 50 via the respective four downstream first paths 8*a*. The downstream curved path 9 connects between the downstream second path 8*b* and the second output tray 4. Accordingly, the sheet P conveyed from one of the four recording modules 50 can be discharged onto the second output tray 4 via a corresponding one of the downstream first paths 8*a*, the downstream second path 8*b*, and the downstream curved path 9. That is, the downstream first paths 8*a*, the downstream second path 8*b*, and the downstream curved path 9 are a common output path for the sheet P discharged from any one of the four recording modules 50. In the present embodiment, the downstream first paths 8*a*, the downstream second path 8*b*, and the downstream curved path 9 constitute a shared output path. The downstream curved path 9 of this shared output path has a generally arc shape extending from the upper end of the guide 33 to the second output tray 4. Thus, when the sheet P conveyed from each of the recording modules 50 is discharged onto the second output tray 4 via the shared output path, the upper surface at the point in time when the sheet P has last conveyed through the recording module 50 is supported on the support surface 4*a* of the second output tray 4 (i.e., a face-down discharge of the sheet P).

The four switching mechanisms 38*a*-38*d* include respective switchers 38*a*1-38*d*1 and respective switching motors 38*a*M-38*d*M (see FIG. 7). Each of these switchers 38*a*1-38*d*1 is supported by a corresponding one of pins 1*a*7 formed in the housing 1*a* such that each switcher is pivotable. Each of the switchers 38*a*1-38*d*1 is driven by a corresponding one of the switching motors 38*a*M-38*d*M controlled by the controller 100 so as to be selectively positioned at one of a first conveyed position and a second conveyed position.

With each of the switchers 38*a*1-38*d*1 being located at the first conveyed position, a distal end of the switcher is held in contact with the guides 34, to isolate a corresponding one of the downstream first paths 8*a* from a corresponding one of the downstream third paths 8*c* which is held in contact with the switcher, so that the sheet P is guided from the corresponding one of the downstream first paths 8*a* to the downstream second path 8*b*. When each of all the switchers 38*a*1-38*d*1 is positioned at the first conveyed position as illustrated in FIG. 3, the downstream first paths 8*a*, the downstream second path 8*b*, the downstream curved path 9, and the re-conveyance path 10 communicate with each other. When the sheet P conveyed from the recording modules 50 is conveyed to the downstream second path 8*b*, the controller 100 controls the switching motors 38*a*M-38*d*M to position each of the switchers 38*a*1-38*d*1 to the first conveyed position.

With each of the switchers 38*a*1-38*d*1 being located at the second conveyed position, the distal end of the switcher is held in contact with the guide 33 such that the sheet P is guided from a corresponding one of the downstream first paths 8*a* to a corresponding one of the downstream third paths 8*c* which is connected to the corresponding one of the downstream first paths 8*a* in a straight line. Specifically, when the sheet P conveyed from the uppermost recording module 50 is conveyed to the uppermost first output tray 11 corresponding to this recording module 50, as illustrated in FIG. 1, the controller 100 drives the switching motor 38*a*M to position the switcher 38*a*1 to the second conveyed position. When the sheet P conveyed from the second recording module 50 from the top is conveyed to the second first output tray 11 from the top corresponding to this recording module 50, the controller 100 drives the switching motor 38*b*M to position the switcher 38*b*1 to the second conveyed position. When the sheet P conveyed from the third recording module 50 from the top is conveyed to the third first output tray 11 from the top, the switcher 38*c*1 is positioned to the second conveyed position, and when the sheet P conveyed from the lowermost recording module 50 is conveyed to the lowermost first output tray 11, the switcher 38*d*1 is positioned to the second conveyed position.

There will be next explained the re-conveyance guide unit 41 of the conveying mechanism 20 with reference to FIG. 1. One end of the guide 42 of the re-conveyance guide unit 41 is connected to the lower end of the guide 33 of the downstream guide unit 31. The other end of the guide 42 is connected to the joining point 15 at which the upstream curved path 5 of the upstream guide unit 21 and the upstream conveyance path 6 are joined together. That is, the re-conveyance path 10 is defined by the guide 42. The sheet sensors 45, 46 for sensing the conveyed sheet P are provided respectively at the one end and the other end of the guide 42. When having sensed the sheet P, each of the sheet sensors 45, 46 outputs a signal to the controller 100.

Here, each of the six conveying roller pairs 36 of the downstream guide unit 31 is controlled by the controller 100 to change a direction of conveyance of the sheet P. That is, when the sheet P conveyed from the recording module 50 is conveyed to the second output tray 4 by the conveying roller pairs 36, the conveying roller pairs 36 are rotated such that the sheet P is conveyed upward until the sheet P is discharged onto the second output tray 4. On the other hand, when the sheet P conveyed from the recording modules 50 is conveyed to any one of the four recording modules 50 again by the conveying roller pairs 36 (when the sheet P is conveyed to the re-conveyance path 10 by the conveying roller pairs 36), the conveying roller pairs 36 are rotated such that the sheet P is conveyed upward until the trailing edge of the sheet P is sensed by the sheet sensor 47 (i.e., until the trailing edge of the sheet P is conveyed to the downstream curved path 9). When the trailing edge of the sheet P is sensed by the sheet sensor 47, the rotational direction of the conveying roller pairs 36 is switched such that the sheet P is conveyed downward with the trailing edge thereof as a leading edge, and then the sheet P is conveyed to the re-conveyance path 10 through the downstream second path 8*b*. The sheet P conveyed to the re-conveyance path 10 is conveyed to the upstream conveyance path 6 again by rotation of the conveying roller pairs 43 of the re-conveyance guide unit 41. In this re-conveyance, the sheet P is conveyed with its front and back surfaces being reversed when compared with the preceding conveyance of the sheet P through the upstream conveyance path 6 the second conveyance path). In other words, the downstream first paths 8*a*, the downstream second path 8*b*, the downstream curved path 9, and the re-conveyance path 10 connect between the downstream ends of the intermediate conveyance paths 7 of the respective four recording modules 50 and the upstream conveyance path 6 such that the front and back surfaces are reversed when compared with the preceding conveyance of the sheet P through the upstream conveyance path 6.

In the present embodiment, the downstream first paths 8*a*, the downstream second path 8*b*, the downstream curved path 9, and the re-conveyance path 10 constitute the third conveyance path. Also, the conveying roller pairs 36 and the conveying motor 36M constitute a third switcher configured to switch a destination of the sheet P conveyed to the downstream end of the intermediate conveyance path 7 of any one of the four recording modules 50, to any of the re-conveyance path 10 (i.e., the third conveyance path) and the second output tray 4. In addition, the four switching mechanisms 38*a*-38*d* constitute a first switcher configured to selectively switch a destination of the sheet P conveyed to the downstream end of the intermediate conveyance path 7 of any one of the recording modules 50, to any one of the re-conveyance path 10 (i.e., the third conveyance path) and the first output trays 11 (as the at least fourth conveyance path).

It is noted that, as described above, the at least one fourth conveyance path is constituted by the downstream first paths 8*a* and the downstream third paths 8*c*, and the shared output path is constituted by the downstream first paths 8*a*, the downstream second path 8*b*, and the downstream curved path 9. That is, in the present embodiment, the downstream first paths 8*a* are shared by the third conveyance path, the at least one fourth conveyance path, and the shared output path. The downstream second path 8*b* is shared by the third conveyance path and the shared output path.

Figure 4:
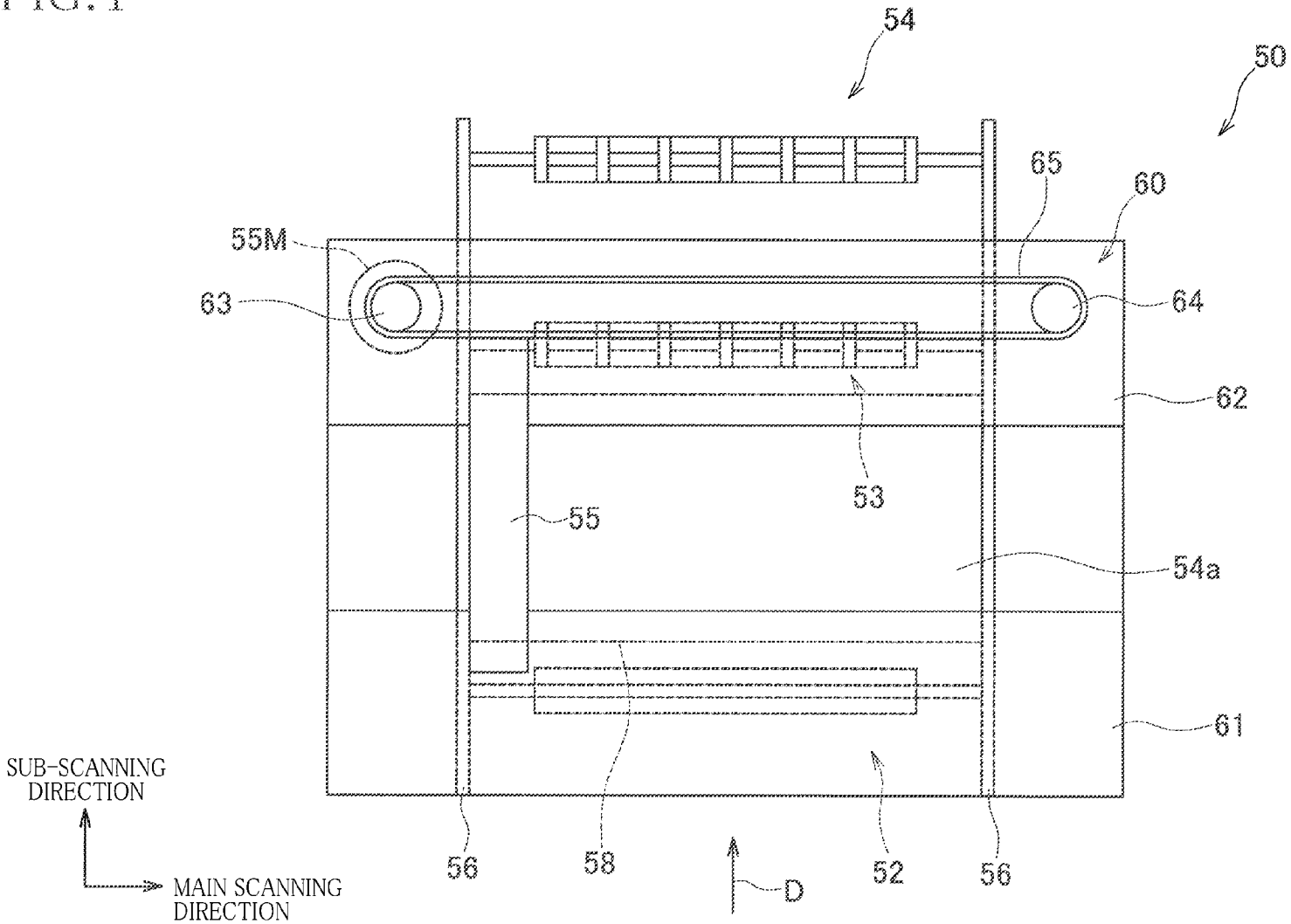
FIG. 4 is a plan view of a recording module illustrated in FIG. 1.
Figure 5:
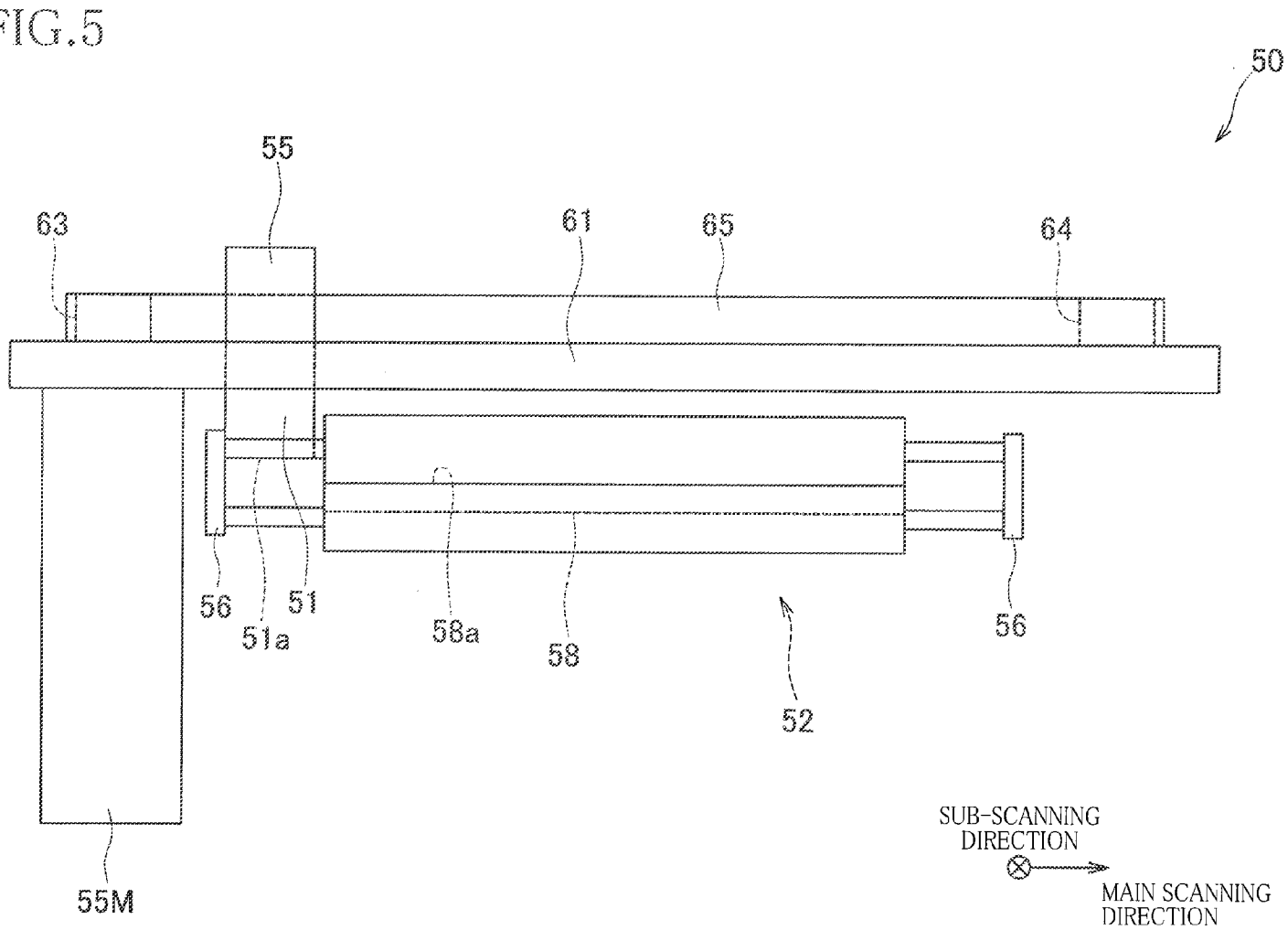
FIG. 5 is a front elevational view of the recording module illustrated in FIG. 1.
Figure 6:
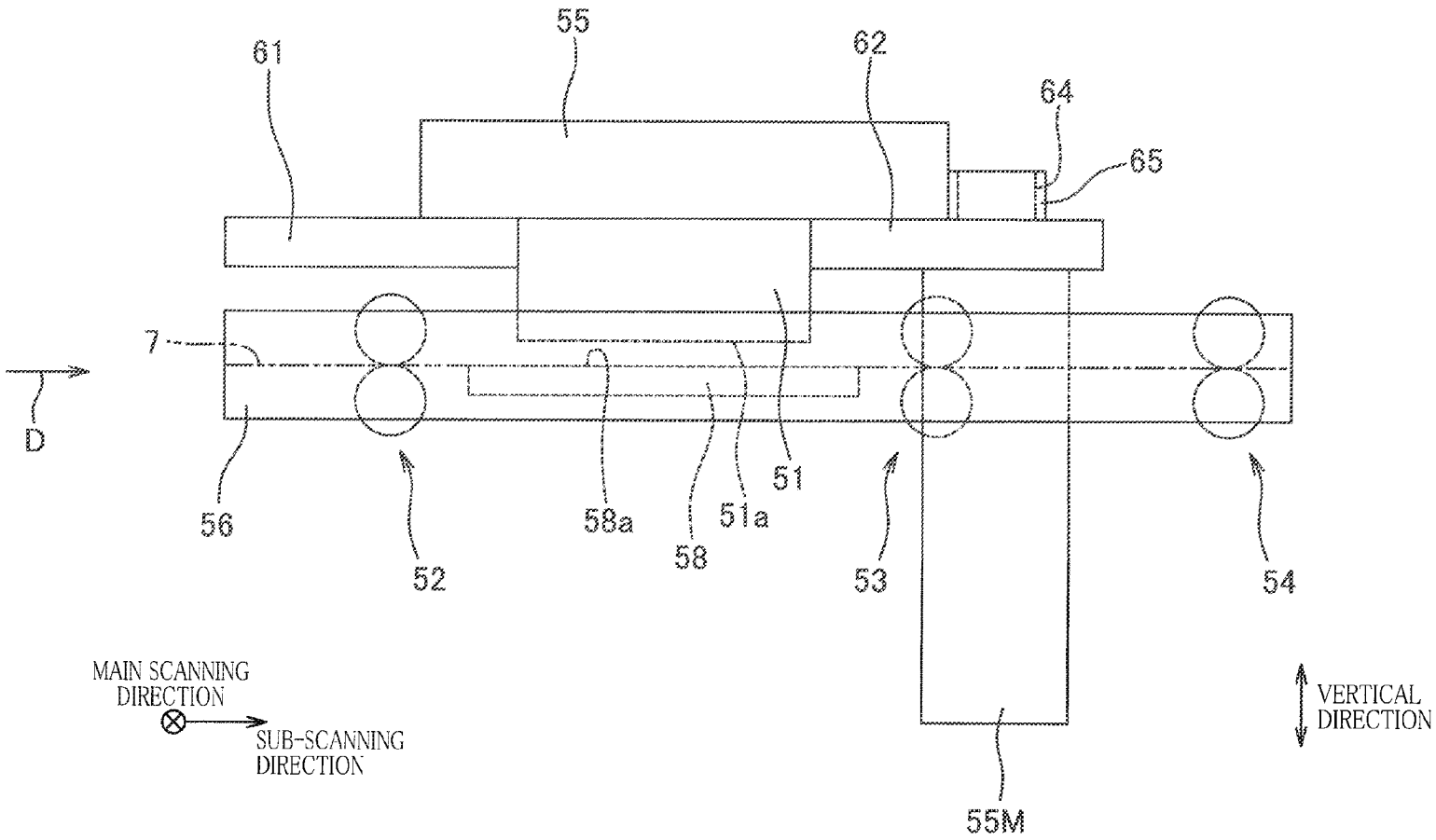
FIG. 6 is a side view of the recording module illustrated in FIG. 1.

There will be next explained the four recording modules 50 with reference to FIGS. 4-6. The four recording modules 50 have the same configuration, and accordingly the following explanation is provided only for one recording module 50 for the sake of simplicity. The recording module 50 includes the head 51, the three conveying roller pairs 52-54, a platen 58, a carriage 55, a pair of flanges 56, and a moving mechanism 60. The head 51 has a generally rectangular parallelepiped shape, and an upper surface thereof is supported by the carriage 55. A lower surface of the head 51 is an ejection surface 51*a* formed with a multiplicity of ejection openings. During recording, the head 51 ejects the black ink from the ejection surface 51*a*. The head 51 is supported by the housing 1*a* via the carriage 55 and the moving mechanism 60, and a space appropriate for recording is formed between the ejection surface 51*a* and the platen 58.

As illustrated in FIGS. 4 and 6, the pair of flanges 56 extend in parallel so as to be spaced apart from each other by a fixed distance. The pair of flanges 56 support the platen 58 and also support the three conveying roller pairs 52-54 rotatably. The platen 58 is disposed at a position opposite the ejection surface 51*a* of the head 51. The platen 58 has a flat conveying surface 58*a* and supports a lower side of the sheet P. The platen 58 defines a recording region (i.e., a portion of the intermediate conveyance path 7) between the platen 58 and the ejection surface 51*a*. The three conveying roller pairs 52-54 are arranged in parallel with each other and convey the sheet P in a direction perpendicular to a direction in which each roller pair extends. The direction in which the sheet P is conveyed is the sheet conveying direction D (or the sub-scanning direction). Each of the three conveying roller pairs 52-54 is rotated by a corresponding one of conveying motors 52M-54M (see FIG. 7) controlled by the controller 100 to convey the sheet P in the sheet conveying direction D. The intermediate conveyance path 7 is defined between rollers of each of the conveying roller pairs 52-54 and between the ejection surface 51*a* of the head 51 and the platen 58. In the present embodiment, this intermediate conveyance path 7 extends parallel with the sub-scanning direction. It is noted that the intermediate conveyance path 7 may be partly curved.

The moving mechanism 60 includes a pair of guides 61, 62, two pulleys 63, 64, a belt 65, and a carriage motor 55M (see FIG. 7). As illustrated in FIGS. 4 and 6, the pair of guides 61, 62 each having a rectangular shape in plan view are spaced apart from each other in the sub-scanning direction such that an upper portion of the head 51 is interposed between the pair of guides 61, 62. The pair of guides 61, 62 support opposite ends of the carriage 55 in the sub-scanning direction such that the carriage 55 is slideable in the main scanning direction. The two pulleys 63, 64 are rotatably supported respectively by opposite ends of the guide 62 in the main scanning direction. These pulleys 63, 64 have the same diameter and are arranged at the same position in the sub-scanning direction. The belt 65 is an endless belt looped over the two pulleys 63, 64 and rotated by rotation of the pulley 63. A portion of the belt 65 is mounted on the carriage 55. The carriage motor 55M is fixed to a lower surface of the guide 62. The carriage motor 55M has a circular cylindrical shape elongated in the vertical direction. A rotation shaft of the carriage motor 55M is mounted on the pulley 63.

When the controller 100 drives the carriage motor 55M so as to rotate the pulley 63 forwardly or reversely, the head 51 is reciprocated in the main scanning direction with the carriage 55. During this reciprocation, the controller 100 controls the head 51 to eject the ink from the ejection surface 51*a* at desired timings, so that an image can be recorded on an upper surface of the conveyed sheet P. The head 51, the carriage 55, and the moving mechanism 60 constitute a recording device configured to record an image on the upper surface of the sheet P. It is noted that the pulley 64 is a driven pulley which is rotated by travel of the belt 65. The sheet P on which an image has been recorded (hereinafter may be referred to as "image-recorded sheet P" is conveyed to the downstream conveyance path 8 by further rotation of the three conveying roller pairs 52-54 controlled by the controller 100.

There will be next explained an electric configuration of the printer 1 with reference to FIG. 7. The controller 100 includes a central processing unit (CPU) 91 as a computing device, a read only memory (ROM) 92, a random access memory (RAM) 93 (including a non-transitory RAM), an application specific integrated circuit (ASIC) 94, and a timer. The ROM 92 stores programs to be executed by the CPU 91, various kinds of fixed data, and other similar data. The RAM 93 temporarily stores data necessary for execution of the programs, such as image data, identification information, selected tray information, and page data. That is, the RAM 93 includes an image-data storage 111, an identification information storage 112, a selected tray information storage 113, and four page data storages 114. The ASIC 94 includes a recording module control circuit 121, the conveyance control circuit 122, a sorting circuit 123, and an input/output control circuit 124. The ASIC 94 is connected to the external device 97 via an input/output interface 96 as one example of a receiver such that data communication can be executed between the ASIC 94 and the external device 97. As illustrated in FIG. 7, the controller 100 is also connected to the sheet-supply motor 3*b*M, the conveying motors 25M, 36M, 43M, the sheet sensors 45, 46, 47, the switching motors 27*a*M-27*c*M, 38*a*M-38*d*M, a touch panel 98, the recording modules 50, and so on.

It is noted that the single CPU 91 executes processings relating to various controls in the present embodiment, but this invention is not limited to this configuration. For example, the processings may be executed by a plurality of CPUs, an ASIC, or a combination of one or more CPUs and one or more ASICs.

The image-data storage 111 stores image data contained in a recording command transmitted from the external device 97. The image data contains at least one page data representative of an image corresponding to one page. The following explanation is provided assuming that the image data contains a plurality of page data.

The identification information storage 112 stores identification information containing an identifier for identifying a device which has transmitted a recording command. The identification information includes: text information such as the name of the external device 97 as the device having transmitted the recording command; and pictorial information assigned to each external device 97. As a modification, the identification information may be information containing at least one identifier for individually identifying image data.

The selected tray information storage 113 stores selected tray information indicating one of the four first output trays 11 or the second output tray 4, as an output tray onto which the sheet P is to be discharged. The four page data storages 114 correspond to the respective four recording modules 50 and each stores page data for images to be recorded by a corresponding one of the recording modules 50.

The recording module control circuit 121 controls each of the four recording modules 50 such that an image based on page data stored in the corresponding one of the four page data storages 114 is recorded on the sheet P. The recording module control circuit 121 determines whether there is a sheet P on the downstream second path 8*b* and the downstream curved path 9 or not based on a result of the detection of the sheet sensor 45. Only when there is no sheet P on the downstream second path 8*b* and the downstream curved path 9, the recording module control circuit 121 controls the recording module 50 to convey the sheet P from the recording module 50 to the downstream second path 8*b* or the downstream third paths 8*c*.

The conveyance control circuit 122 controls the conveying motors 25M, 36M, 43M, and the switching motors 27*a*M-27*c*M, 38*a*M-38*d*M such that the sheet P is conveyed from the sheet-supply unit 3 selectively to one of the recording modules 50 and such that the sheet P on which an image has been recorded by the recording module 50 is to be discharged onto an output tray indicated by the selected tray information stored in the selected tray information storage 113, among the four first output trays 11 and the second output tray 4. In the present embodiment, as described above, the sheet P can be selectively discharged onto one of the four first output trays 11 or the second output tray 4, thereby sorting the printed sheets. For example, in a case where the printer 1 is shared by a plurality of users, each of the printed sheets can be selectively discharged onto a corresponding one of output trays respectively assigned to the users, preventing the printed sheets for a plurality of users from being mixed on a single output tray.

The sorting circuit 123 sorts a plurality of page data contained in image data stored in the image-data storage 111 into four groups respectively corresponding to the four recording modules 50 and stores each page data into a corresponding one of the page data storages 114 respectively corresponding to the recording modules 50.

The input/output control circuit 124 controls data communication between the controller 100 and the touch panel 98 and data communication between the controller 100 and the external device 97 via the input/output interface 96. Specifically, when having received a recording command from the external device 97, for example, the input/output control circuit 124 stores selected tray information contained in the received recording command, into the selected tray information storage 113. As a modification, the input/output control circuit 124 may store the selected tray information into the selected tray information storage 113 based on user input received from the touch panel 98. This input/output control circuit 124 is one example of a first specifying device for specifying one of the four first output trays 11 as a specific output tray onto which the sheet P is to be discharged, and a second specifying device for specifying one of the first output trays 11 and the second output tray 4, as an output tray onto which the sheet P is to be discharged.

Incidentally, as described above, the downstream first paths 8*a* and the downstream third paths 8*c* (i.e., the at least one fourth conveyance path) connect between the intermediate conveyance paths 7 and the first output trays 11 such that the surface of the sheet P which is a back side from the upper surface thereof at the point in time when the sheet P has last conveyed through the recording module 50 is supported by the support surface 12 of a corresponding one of the first output trays 11. Thus, in a case where the sheet P is discharged onto the first output tray 11 via the downstream first paths 8*a* and the downstream third path 8*c* after an image is recorded on the upper surface of the sheet P when the sheet P is last conveyed through the recording module 50, the sheet P is discharged onto the first output tray 11 in a state in which the surface of the sheet P on which the image has just been recorded (i.e., an image-recorded surface) faces upward (i.e., what is called a face-up discharge of the sheet P). If the sheets P are discharged in order onto the first output tray 11 in the state in which the image-recorded surface faces upward, the page order of the sheets P to be supported by the first output tray 11 is reverse to the order of recording of the images by the recording module 50. In order to collate the pages of the image-recorded sheets P, the user needs to rearrange the sheets P in the right order, placing a heavy load on the user. Also, if the sorting circuit 123 rearranges the page data in the order reverse to the page order and stores the page data into the page data storage 114, the sheets P are discharged onto the first output tray 11 in the right page order, but this rearrangement of the page data requires a larger amount of memory and a longer time for image recording on the sheets P.

In order to solve these problems, in the present embodiment, when the sheets P are discharged onto the first output tray 11, the sheet P on which the entire image or all the images to be recorded by the recording module 50 is turned upside down on the third conveyance path and thereafter discharged onto the first output tray 11 via the recording module 50. This configuration allows the sheet P to be discharged onto the first output tray 11 in the state in which the surface on which the image has been just recorded faces downward.

Here, even when an image based on the image data is to be recorded on only one side of the sheet P, the sheet P passes through the recording module 50 twice. When the sheet P last passes through the recording module 50, no image recording is performed on the sheet P, and the sheet P is conveyed in the state in which its image-recorded surface faces downward. In the present embodiment, the recording module control circuit 121 controls the recording module 50 during this second passing to record the identification information stored in the identification information storage 112, onto a surface of the sheet P which is a back side from the image-recorded surface (i.e., a surface on which no image has been recorded).

Simplex Recording

There will be next explained one example of a control of the printer 1 when a recording command for recording an image on only one side of the sheet P is received from the external device 97. This control is executed according to the programs stored in the ROM 92.

When the recording command for recording an image on only one side of the sheet P is received from the external device 97, the input/output control circuit 124 stores the image data contained in the recording command into the image-data storage 111 and stores the selected tray information into the selected tray information storage 113. Also, the input/output control circuit 124 stores, into the identification information storage 112, identification information, containing an identifier indicating a device having transmitted the recording command. At this time, the sorting circuit 123 sorts the plurality of page data contained in the image data stored in the image-data storage 111 into the four groups and stores each page data into a corresponding one of the page data storages 114. As a modification, the input/output control circuit 124 may not store the image data into the image-data storage 111, and the sorting circuit 123 may directly transmit the page data from the external device 97 to the page data storages 114 based on information contained in the recording command received from the external device 97.

When the selected tray information stored in the selected tray information storage 113 indicates any one of the four first output trays 11, the controller 100 executes a first image recording operation, and when the selected tray information indicates the second output tray 4, the controller 100 executes a second image recording operation.

First Image Recording Operation

There will be next explained the first image recording operation with reference to FIGS. 8-10B. The following explanation is provided for a case where the selected tray information indicates the uppermost first output tray 11 (hereinafter referred to as "specific output tray 11*a*") as an output tray on which the sheet P is to be discharged. In FIGS. 8-10B, an ordinal number of a sheet to be supplied from the sheet-supply tray 3*a* is added as a suffix to the character "P" for the sheet. For example, P1 indicates the first sheet supplied from the sheet-supply tray 3*a*, and P2 indicates the second sheet supplied from the sheet-supply tray 3*a*.

Figure 8:
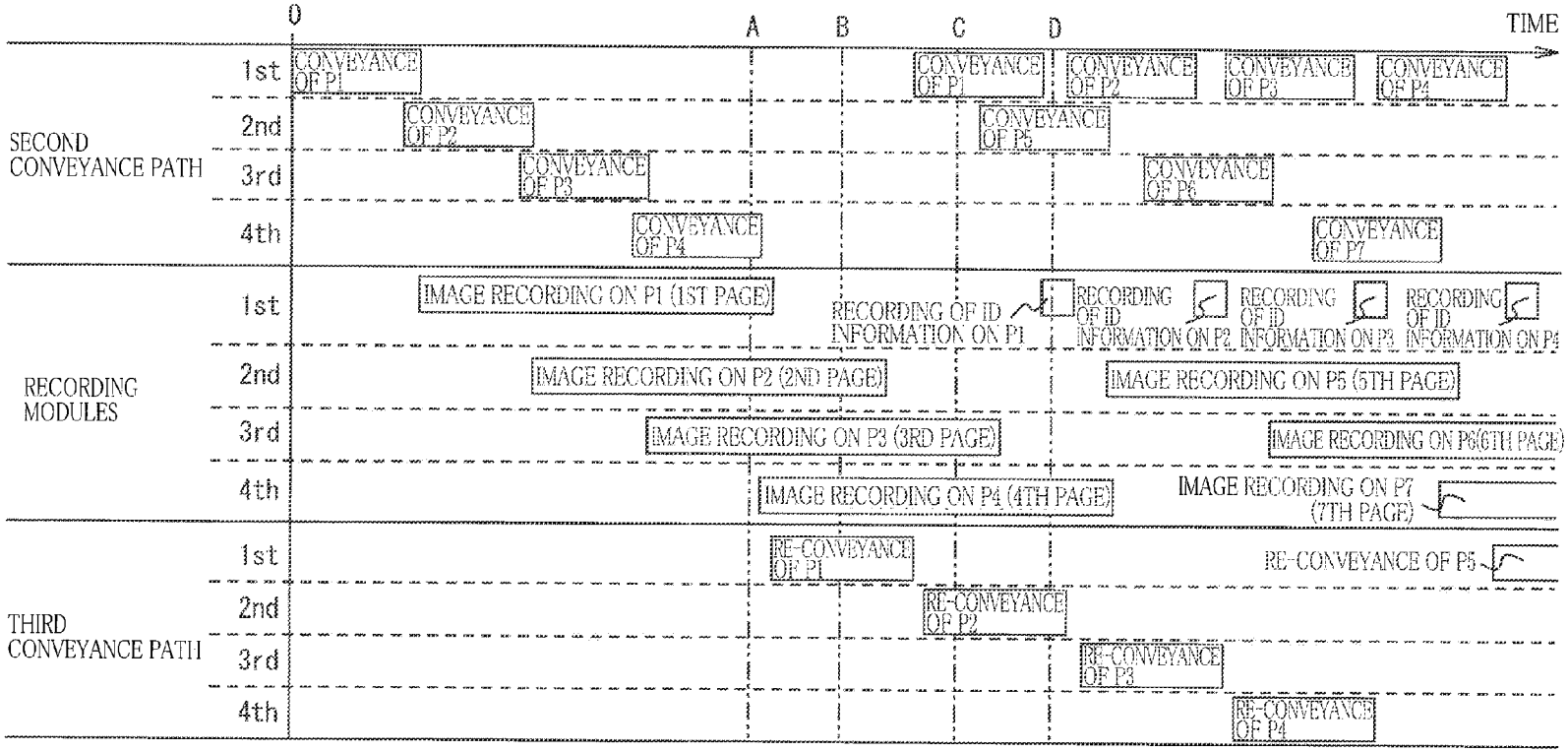
FIG. 8 is a timing chart in a case where image recording is performed on one side of a sheet.

FIG. 8 is a timing chart of the printer 1, wherein the field "SECOND CONVEYANCE PATH" indicates a processing for conveying the sheet P along the second conveyance path (i.e., the upstream first path 6*a* and the upstream second paths 6*b*), the field "RECORDING MODULES" indicates a processing for image recording and the like on the sheet P by the recording modules 50, and the field "THIRD CONVEYANCE PATH" indicates a processing for conveying the sheet P along the third conveyance path (i.e., the downstream first paths 8*a*, the downstream second path 8*b*, the downstream curved path 9, and the re-conveyance path 10). In each of the fields "SECOND CONVEYANCE PATH", "RECORDING MODULES", and "THIRD CONVEYANCE PATH", the term 1st indicates a relation to the uppermost recording module 50, the term 2nd indicates a relation to the second recording module 50 from the top, the term 3rd indicates a relation to the third recording module 50 from the top, and the term 4th indicates a relation to the lowermost recording module 50. For example, the term 1st in the field "SECOND CONVEYANCE PATH" indicates a processing for conveying the sheet P to the uppermost recording module 50, and the term 2nd in the field "SECOND CONVEYANCE PATH" indicates a processing for conveying the sheet P to the second recording module 50 from the top. The term 1st in the field "RECORDING MODULES" indicates various operations performed for the sheet P by the uppermost recording module 50, and the term 2nd in the field "RECORDING MODULES" indicates various operations performed for the sheet P by the second recording module 50 from the top. The term 1st in the field "THIRD CONVEYANCE PATH" indicates a processing of re-conveyance of the sheet P discharged from the uppermost recording module 50, and the term 2nd in the field "THIRD CONVEYANCE PATH" indicates a processing of re-conveyance of the sheet P discharged from the second recording module 50 from the top.

Figure 9A:
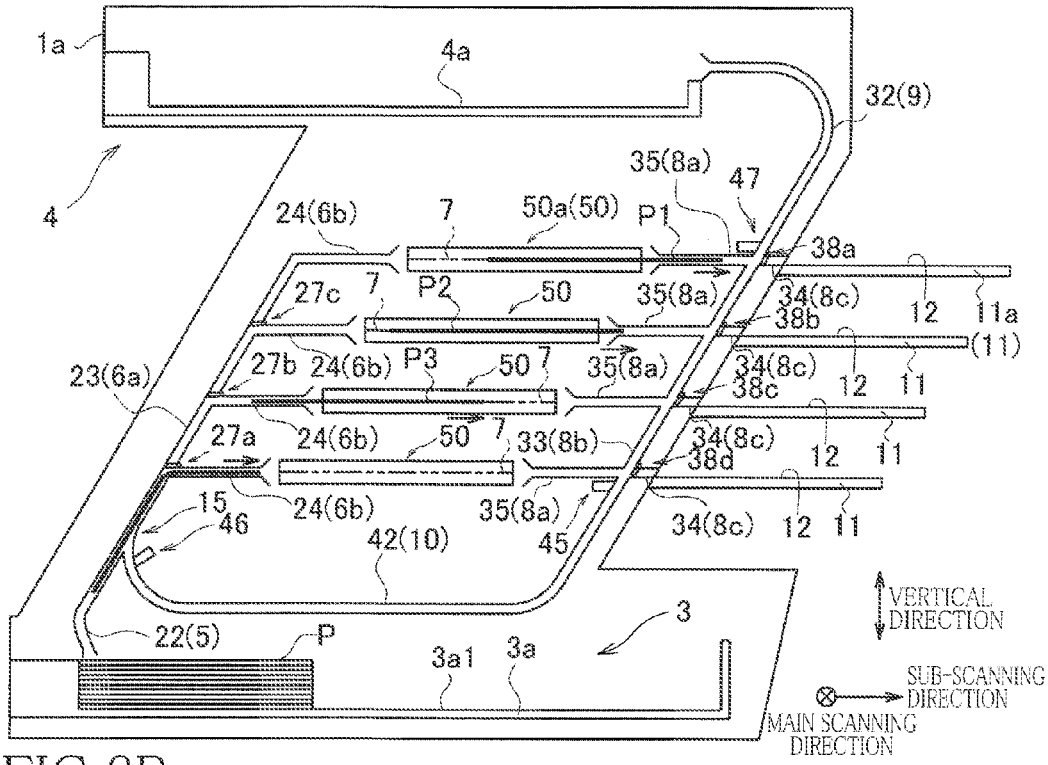
FIG. 9A is a schematic side view illustrating a position of a sheet at a point in time A illustrated in FIG. 8.
Figure 9B:
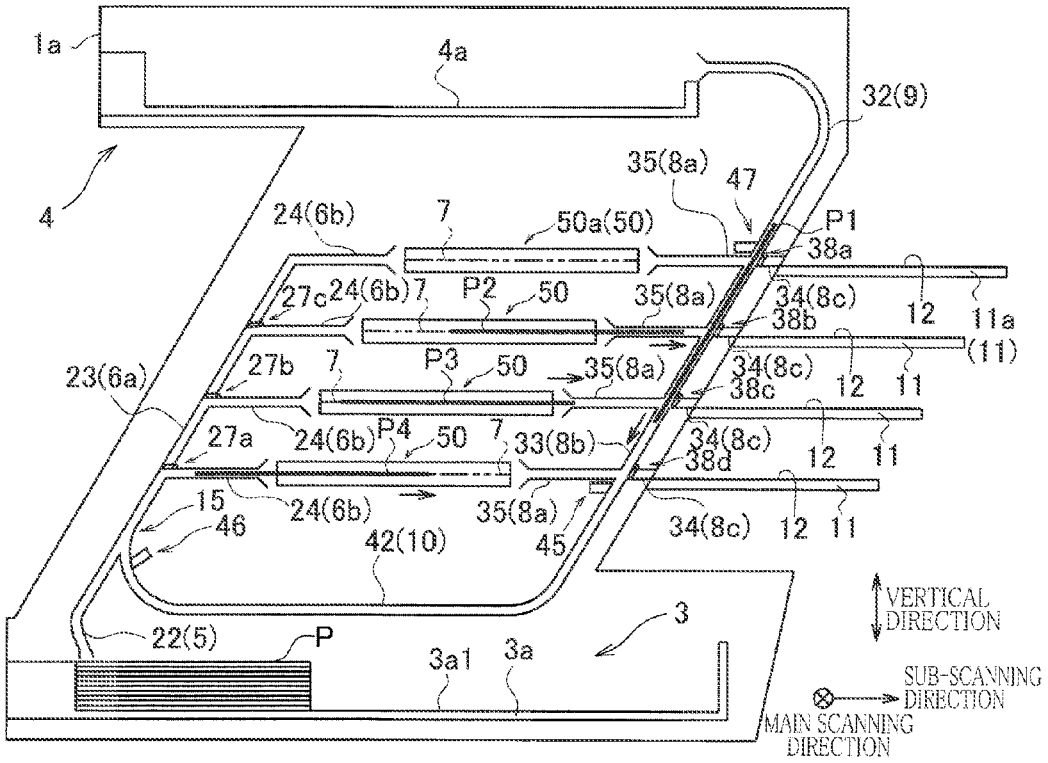
FIG. 9B is a schematic side view illustrating a position of a sheet at a point in time B illustrated in FIG. 8.
Figure 10A:
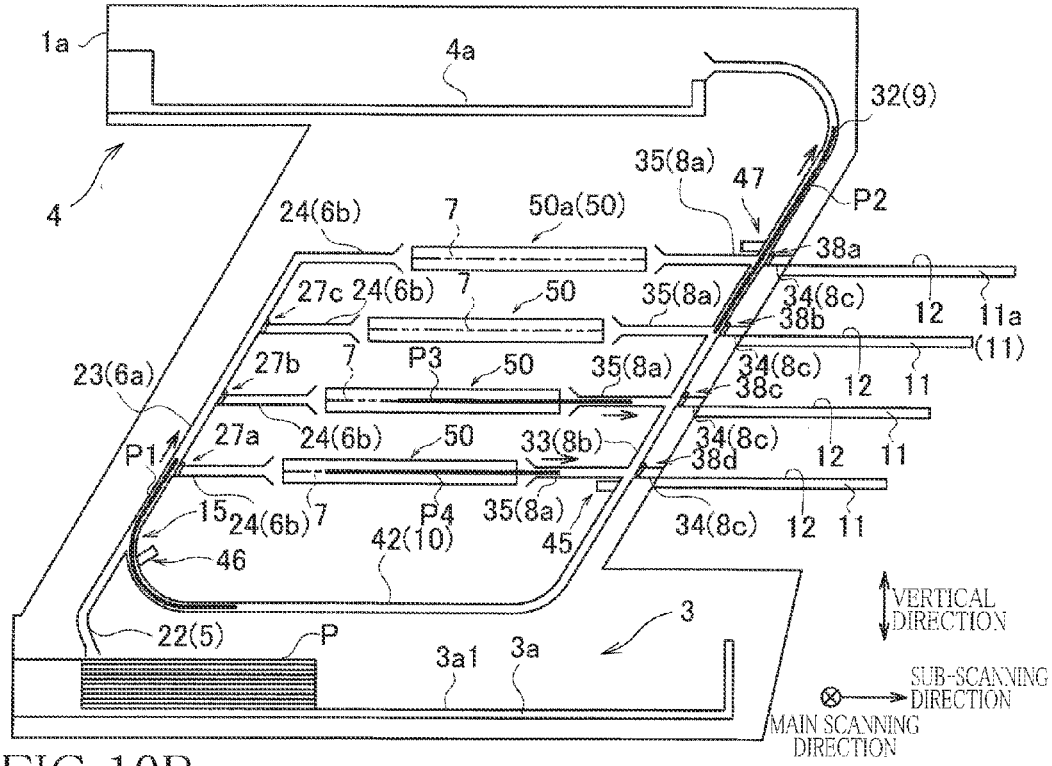
FIG. 10A is a schematic side view illustrating a position of a sheet at a point in time C illustrated in FIG. 8.
Figure 10B:
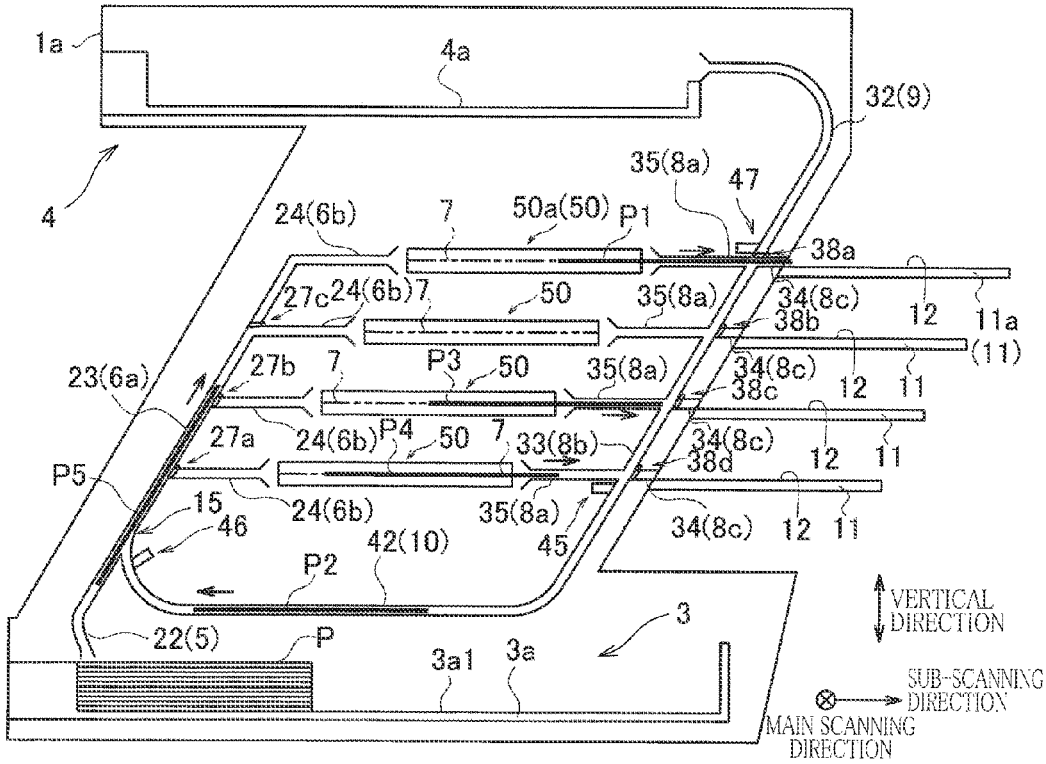
FIG. 10B is a schematic side view illustrating a position of a sheet at a point in time D illustrated in FIG. 8.

FIG. 9A illustrates the position of the conveyed sheet at the point in time A illustrated in FIG. 8, FIG. 9B illustrates the position of the conveyed sheet at the point in time B illustrated in FIG. 8, FIG. 10A illustrates the position of the conveyed sheet at the point in time C illustrated in FIG. 8, and FIG. 10B illustrates the position of the conveyed sheet at the point in time D illustrated in FIG. 8. In FIGS. 9A-10B, illustrations of the conveying roller pairs 25, 36, 43, and illustrations of the recording modules 50, the conveying mechanism 20, and so on are simplified for easier understanding.

The conveyance control circuit 122 executes a processing for supplying the sheet P from the sheet-supply tray 3*a* to the recording modules 50. Specifically, the conveyance control circuit 122 drives the sheet-supply motor 3*b*M for the sheet-supply roller 3*b* and drives the conveying motor 25M for the conveying roller pairs 25. In this operation, the switching motors 27*a*M-27*c*M for the respective switching mechanisms 27*a*-27*c* are also controlled according to the recording module 50 used to convey the sheet P. In the present embodiment, only when the conveyance control circuit 122 determines, based on detection of the sheet sensors 45, 46, that there is no sheet P on the re-conveyance path 10, the conveyance control circuit 122 controls the sheet-supply motor 3*b*M so as to supply the sheet P from the sheet-supply tray 3*a*.

Incidentally, when image recording is being performed on the sheet P by the uppermost recording module 50 corresponding to the specific output tray 11*a* (hereinafter referred to as "second recording module 50*a*"), the sheet P conveyed from each of the four recording modules 50 to the second recording module 50*a* again cannot pass through the second recording module 50*a*. Thus, re-conveyance of the sheet P to the second recording module 50*a* needs to be stopped until completion of the image recording on the sheet P by the second recording module 50*a*. Thus, in the present embodiment, the recording of the image on the sheet P based on the image data is performed by each of the recording modules 50 other than the second recording module 50*a* with a higher priority than the second recording module 50*a*.

More specifically, the sorting circuit 123 stores only page data corresponding to the first page into the page data storage 114 corresponding to the second recording module 50*a* and sorts and stores other page data into the three page data storages 114 corresponding to the respective recording modules 50 other than the second recording module 50*a*. Page data whose page numbers satisfy the condition "N+3M" (M=0, 1, 2, 3, . . . ) are stored into the respective three page data storages 114. It is noted that the number N is a page number of page data whose page number is the lowest (earliest) among the page data to be stored into the three page data storages 114, and the number N is 2, 3, and 4 in the present embodiment. Accordingly, page data corresponding to, e.g., the fifth page and the eighth page are to be stored into the page data storage 114 into which the page data corresponding to the second page is to be stored.

The conveyance control circuit 122 controls the switching motors 27*a*M-27*c*M such that only the first sheet P1 is conveyed from the sheet-supply tray 3*a* to the second recording module 50*a*, and thereafter no sheets P are conveyed from the sheet-supply tray 3*a* to the second recording module 50*a*. Thus, the second recording module 50*a* performs only image recording for the sheet P1 and thereafter performs no image recording. This configuration eliminates a need to stop the re-conveyance of the sheet P to the second recording module 50*a* for image recording by the second recording module 50*a*, resulting in increase in speed of operations of the printer 1.

When the sheet P on which no image has been recorded is conveyed to each of the recording modules 50, the recording module control circuit 121 executes a recording processing for controlling the recording module to record an image on the sheet P based on the page data stored in a corresponding one of the page data storages 114. Specifically, based on the page data stored in each of the page data storages 114, the recording module control circuit 121 drives the head 51 and the carriage motor 55M for the carriage 55 and also drives the conveying motors 52M-54M for the respective conveying roller pairs 52-54. Thus, the image based on the page data is recorded on the sheet P being conveyed by the conveying roller pairs 52-54. It is noted that each of the recording modules 50 performs image recording on the sheets P based on the page data in order from the page data whose page order is low among the page data stored in the corresponding one of the page data storages 114.

The recording module control circuit 121 and the conveyance control circuit 122 execute a re-conveyance processing in which the sheet P having been printed on one side and conveyed from each of the recording modules 50 is conveyed to the second recording module 50*a* again. This re-conveyance of the sheets P to the second recording module 50*a* is performed in order from the sheet P assigned with a low page order among the page data received by the image-data storage 111.

Specifically, the conveyance control circuit 122 controls the switching motors 38*a*M-38*d*M for the respective switching mechanisms 38*a*-38*d* to position each of the switchers 38*a*1-38*d*1 to the first conveyed position. The recording module control circuit 121 then drives the conveying motors 52M-54M for the respective conveying roller pairs 52-54 to convey the sheet P from each of the recording modules 50 to the downstream curved path 9, and the conveyance control circuit 122 drives the conveying motor 36M for the conveying roller pairs 36. When the trailing edge of the sheet P is detected by the sheet sensor 47, the conveyance control circuit 122 controls the conveying roller pairs 36 to be rotated reversely to reverse the direction of conveyance of the sheet P. This operation switches the path for the sheet 1 so that the sheet P is conveyed along the downstream second path 8*b* and the re-conveyance path 10 (see FIG. 9B).

The conveyance control circuit 122 drives the conveying motor 25M for the conveying roller pairs 25 such that the sheet P conveyed from the re-conveyance path 10 to the upstream conveyance path 6 again is conveyed to the second recording module 50*a*, and the conveyance control circuit 122 also drives the switching motors 27*a*M-27*c*M for the respective switching mechanisms 27*a*-27*c* to move each of all the switchers 27*a*1-27*c*1 to the interrupting position (see FIG. 10A). Thus, the sheet P is conveyed to the second recording module 50*a* again in the state in which the image-recorded surface faces downward.

When the sheet P is conveyed to the second recording module 50*a* again, the recording module control circuit 121 executes an identification-information recording processing. Specifically, the recording module control circuit 121 drives the carriage motor 55M such that before the sheet P passes through a position opposite the ejection surface 51*a* of the head 51 of the second recording module 50*a*, the ejection surface 51*a* of the head 51 of the second recording module

Figure 11A:
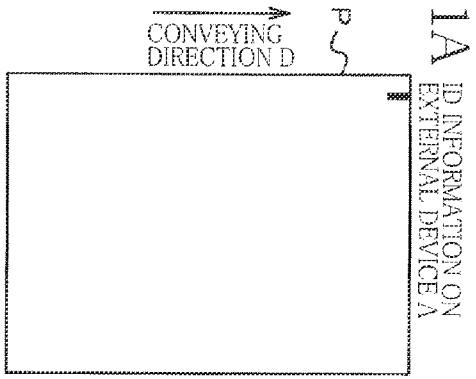
FIGS. 11A-11F are views each illustrating a sheet on which identification information is recorded.
Figure 11B:
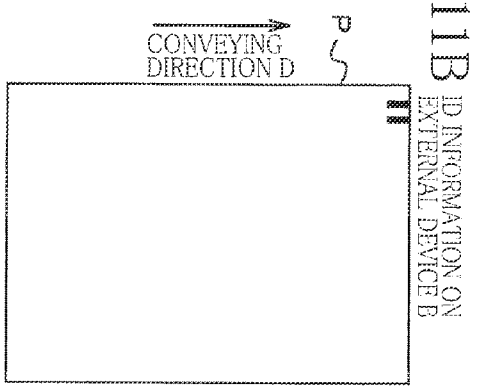

50*a* is moved in advance to a position opposite an edge portion of the conveyed sheet P in the main scanning direction. The recording module control circuit 121 controls the head 51 to eject the ink from the ejection surface 51*a* at desired timings onto the sheet P being conveyed, in a state in which the head 51 is fixed in the main scanning direction. As a result, as illustrated in FIGS. 11A and 11B, the pictorial information associated with each of the external device 97 is recorded on the edge portion of the surface, in the main scanning direction, of the sheet P which is a back side from the image-recorded surface. In this recording, as illustrated in FIGS. 11A and 11B, in a case where the identification information is recorded on the edge portion of the sheet P, a user can easily recognize the identification information recorded on the sheet P by viewing the edge portion of the sheet P discharged on the first output tray 11. It is noted that the identification information is preferably recorded not on an edge portion of a trailing edge portion of the sheet P but on an edge portion of a leading edge portion of the sheet P because the user can view the edge portion of the leading edge portion of the sheet P more easily. As a modification, the identification information may be recorded over the entire length of the sheet P in the sheet conveying direction D.

Figure 11C:
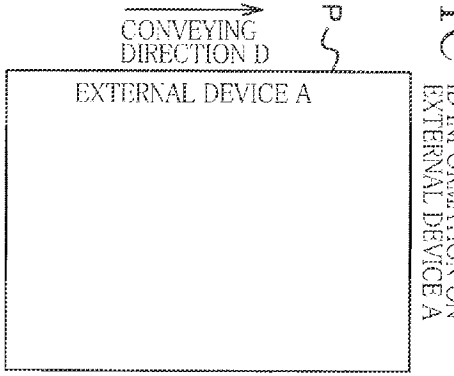
Figure 11D:
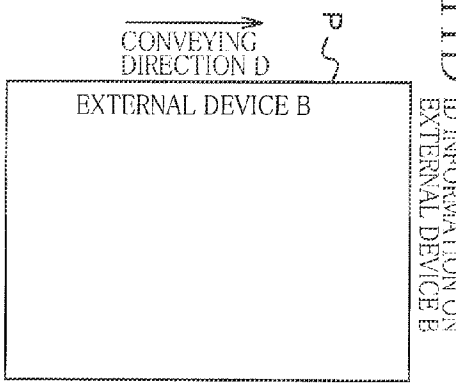
Figure 11E:
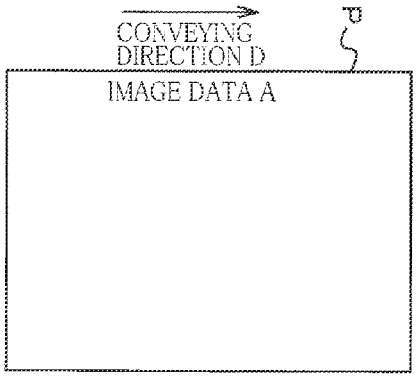
Figure 11F:
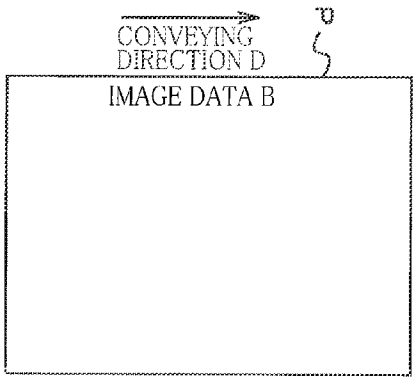

The pictorial information used as the identification information is a line extending in the sub-scanning direction in a case where the arrangement of the ejection openings of the head 51 is parallel with the sub-scanning direction. A plurality of lines can be formed in a case where the ejection openings are arranged in a plurality of rows. In a case where the arrangement of the ejection openings of the head 51 is two-dimensional arrangement, a two-dimensional figure containing text information can be formed. In this case, as illustrated in FIGS. 11C and 11D, a two-dimensional figure containing text information indicating the name of the external device 97 having transmitted the recording command can be formed, for example. Also, the identification information to be stored into the identification information storage 112 may be identification information containing an identifier for individually identifying the image data stored in the image-data storage 111. In this case, as illustrated in FIGS. 11E and 11F, the identification information containing the identifier for individually identifying the image data is recorded on the surface of the sheet P which is a back side from the image-recorded surface.

Since the identification information is recorded on the sheet P in the state in which the head 51 is fixed in the main scanning direction as described above, the head 51 does not need to be reciprocated in the main scanning direction, and accordingly the speed at which the sheet P passes through the intermediate conveyance path 7 is not limited due to wait of movement of the head 51. Thus, an average conveying speed of the sheet P during its passing through the intermediate conveyance path 7 when the identification information is recorded on the sheet P is higher than an average conveying speed of the sheet P during its passing through the intermediate conveyance path 7 when an image is recorded on the sheet P. This configuration can eliminate or reduce operations of stopping the re-conveyance of the sheet P for recording of the identification information by the second recording module 50*a*, resulting in increase in speed of operations of the printer 1.

When the sheet P on which the identification information has been recorded is discharged onto the specific output tray 11*a*, the conveyance control circuit 122 drives the switching motor 38*a*M to move the switcher 38*a*1 to the second conveyed position. The recording module control circuit 121 then controls the conveying motors 52M-54M for the respective conveying roller pairs 52-54 of the second recording module 50*a* to discharge the sheet P onto the specific output tray via the at least one fourth conveyance path (i.e., the downstream first paths 8*a* and the downstream second path 8*b*) in the state in which the image-recorded surface faces downward (see FIG. 10D). In the first image recording operation as described above, the sheet P can be discharged onto the specific output tray 11*a* in the state in which the image-recorded surface faces downward. This configuration eliminates the need for the user to rearrange the image-recorded sheets P in the right page order, thereby reducing a load of the user.

Second Image Recording Operation

There will be next explained the second image recording operation. In the second image recording operation, the sorting circuit 123 selectively stores, into the four page data storages 114, the page data whose page numbers satisfy the condition "N+4M" (M=0, 1, 2, 3, . . . ). The number N is a page number of page data whose page number is the lowest (earliest) among the page data to be stored into the four page data storages 114, and the number N is 1, 2, 3, and 4 in the present embodiment. The conveyance control circuit 122 executes a processing for supplying each of the sheets P from the sheet-supply tray 3*a* to a corresponding one of the four recording modules 50. As a result, the number of the sheets P for which image recording is performed is generally the same among the recording modules 50, resulting in a shortened time required for the image recording.

When the sheet P on which no image has been recorded is conveyed to each of the recording modules 50, the recording module control circuit 121 executes a recording processing for recording an image on the sheet P based on the page data stored in a corresponding one of the page data storages 114. The recording module control circuit 121 and the conveyance control circuit 122 then execute a processing for discharging, onto the second output tray 4, the sheet P having been printed on one side and conveyed from each of the recording modules 50. Specifically, the recording module control circuit 12 controls the switching motors 38*a*M-38*d*M for the respective switching mechanisms 38*a*-38*d* to position each of the switchers 38*a*1-38*d*1 to the first conveyed position. To convey the sheet P from each of the recording modules 50 to the second output tray 4, the recording module control circuit 121 drives the conveying motors 52M-54M for the respective conveying roller pairs 52-54, and the conveyance control circuit 122 drives the conveying motor 36M for the conveying roller pairs 36. Thus, the sheet P conveyed from each of the recording modules 50 is discharged onto the second output tray 4 via the downstream first paths 8*a*, the downstream second path 8*b*, and the downstream curved path 9. Here, since the downstream curved path 9 has a generally arc shape extending from the upper end of the downstream second path 8*b* to the second output tray 4 as described above, the sheet P is discharged onto the second output tray 4 in the state in which the image-recorded surface faces downward. As described above, also in the second image recording operation, the sheet P can be discharged onto the second output tray 4 in the state in which the image-recorded surface faces downward.

Duplex Recording

There will be next explained one example of a control of the printer 1 when a recording command for recording images respectively on both sides of the sheet P is received from the external device 97. This control is also executed according to the programs stored in the ROM 92. When the recording command for recording images respectively on both sides of the sheet P is received from the external device 97, the input/ output control circuit 124 stores the image data contained in the recording command into the image-data storage 111 and stores the selected tray information into the selected tray information storage 113.

When the selected tray information stored in the selected tray information storage 113 indicates any one of the four first output trays 11, the controller 100 executes a third image recording operation, and when the selected tray information indicates the second output tray 4, the controller 100 executes a fourth image recording operation.

Third Image Recording Operation

Figure 12:
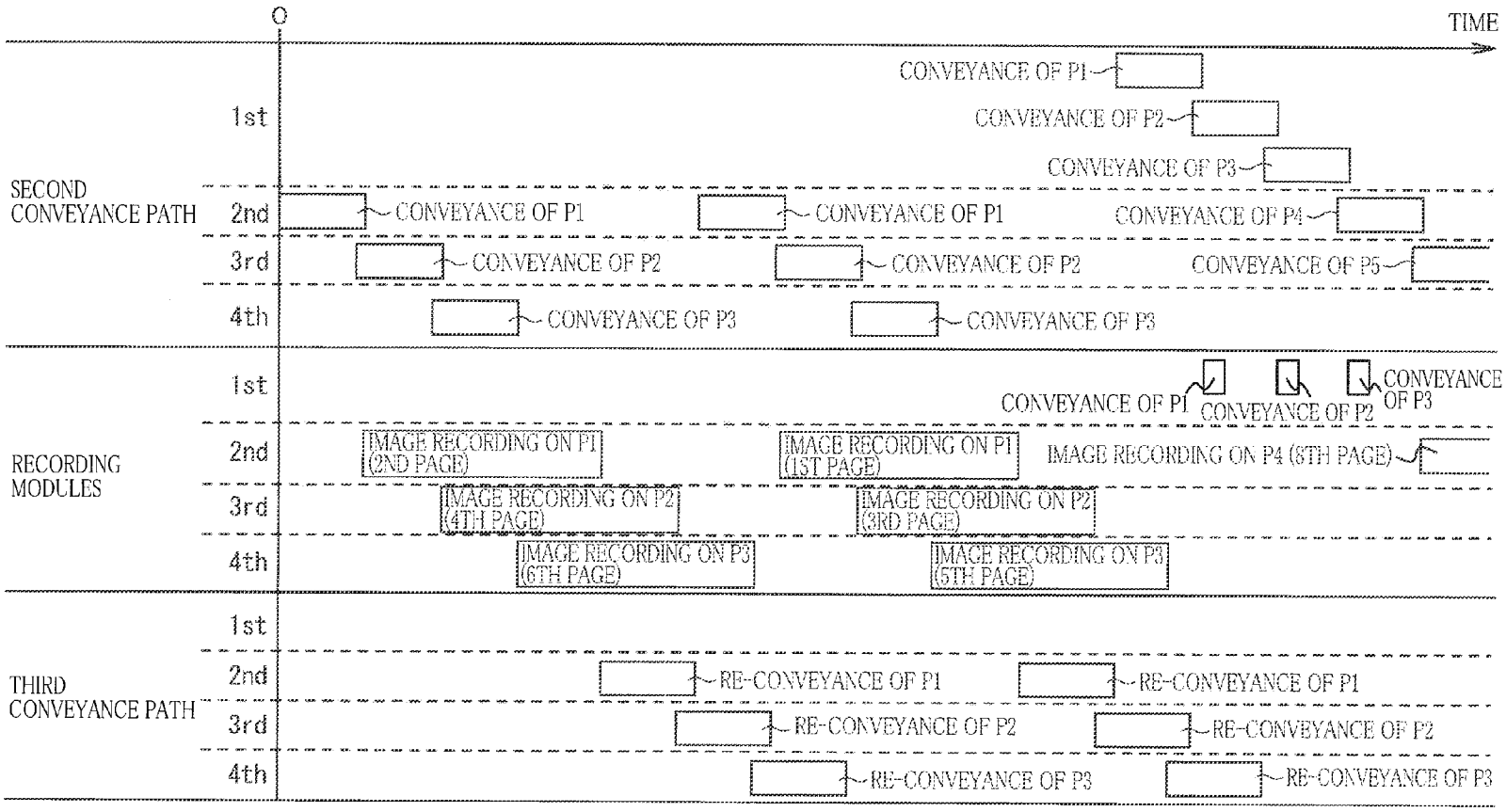
FIG. 12 is a timing chart in a case where image recording is performed on both sides of a sheet.

There will be next explained the third image recording operation with reference to FIG. 12. The following explanation is also provided for the case where the selected tray information indicates the uppermost first output tray 11 (i.e., the specific output tray 11*a*) as an output tray on which the sheet is to be discharged. Accordingly, the uppermost recording module 50 is the second recording module 50*a*.

The conveyance control circuit 122 executes a processing for supplying each of the sheets P from the sheet-supply tray 3*a* to a corresponding one of the recording modules 50. In the third image recording operation, as illustrated in FIG. 12, the recording of the image on the sheet P based on the image data is performed only by the recording modules 50 other than the second recording module 50*a*.

More specifically, the sorting circuit 123 does not store the page data into the page data storage 114 corresponding to the second recording module 50*a*, but sorts and stores the page data selectively into the three page data storages 114 corresponding to the respective recording modules 50 other than the second recording module 50*a*. Here, in the present embodiment, the recording of the images respectively on a first surface and a second surface (opposite surfaces) of the same sheet P is performed by the same recording module 50. Thus, page data whose page numbers satisfy the condition "N+6M" or "N+1+6M" are stored into the respective three page data storages 114. The number N is a page number of page data whose page number is the lowest (earliest) among the page data to be stored into the three page data storages 114, and the number N is 1, 2, and 3 in the present embodiment. Accordingly, page data corresponding to, e.g., the second page, the seventh page, and the eighth page are to be stored into the page data storage 114 into which the page data corresponding to the first page is to be stored (N=1).

The conveyance control circuit 122 controls the switching motors 27*a*M-27*c*M such that no sheets P are conveyed from the sheet-supply tray 3*a* to the second recording module 50*a*. Thus, no image recording is performed on the sheets P by the second recording module 50*a*. This configuration eliminates a need to stop the re-conveyance of the sheet P to the second recording module 50*a* for image recording by the second recording module 50*a*, resulting in increase in speed of operations of the printer 1. Also, since image recording is never performed by the second recording module 50*a*, the control of the controller 100 can be simplified.

When the sheet P on which no image has been recorded is conveyed to each of the recording modules 50, the recording module control circuit 121 executes an image recording processing for recording an image on a first surface (i.e., an upper surface) of the sheet P based on the page data stored in a corresponding one of the page data storages 114. Among page data corresponding to two pages are to be recorded respectively on the first surface and the second surface of the same sheet P, an image based on the page data assigned with the higher (later) page number (i.e., ordinal number) is recorded on the first surface in this recording, and an image based on the page data assigned with the lower page number is to be recorded on the second surface when image recording is performed on the second surface later. Accordingly, in a case where images respectively corresponding to the first and second pages are recorded on the first surface and second surface of the sheet P, respectively, for example, the image corresponding to the second page is recorded on the first surface, and the image corresponding to the first page is recorded on the second surface.

Also, the recording module control circuit 121 and the conveyance control circuit 122 execute a re-conveyance processing in which, in order for the same recording module 50 to record images respectively on the first surface and the second surface of the same sheet P, each sheet P having the image-recorded first surface which is conveyed from a corresponding one of the recording modules 50 is conveyed again to one of the recording modules 50 which is the same as the recording module 50 having printed and conveyed the sheet P.

When the sheet P having the image-recorded first surface is conveyed again to each of the recording modules 50, the recording module control circuit 121 executes an image recording processing for recording an image on the second surface (i.e., the upper surface) of the sheet P based on the image data. The recording module control circuit 121 and the conveyance control circuit 122 then execute a re-conveyance processing in which the sheet P having the image-recorded first and second surfaces which is discharged from each of the recording modules 50 is conveyed to the second recording module 50*a* again. When the sheet P having the image-recorded first and second surfaces is conveyed to the second recording module 50*a* again, the conveyance control circuit 122 drives the switching motor 38*a*M to move the switcher 38*a*1 to the second conveyed position. The recording module control circuit 121 then controls the second recording module 50*a* to discharge the sheet P onto the specific output tray 11*a* without ejecting the ink from the ejection surface 51*a*. In the third image recording operation as described above, the sheet P is discharged onto the specific output tray 11*a* in the state in which the second surface on which the image has been recorded based on the page data assigned with the lower page number faces downward. This configuration can collate the pages of the sheets P discharged on the specific output tray 11*a*, even in the case where the images are recorded respectively on both sides of the sheet P.

Fourth Image Recording Operation

There will be next explained the fourth image recording operation. In the fourth image recording operation, as in the above-described second image recording operation, the four recording modules 50 perform image recording on generally the same number of the sheets P.

The conveyance control circuit 122 executes a processing for supplying each sheet P from the sheet-supply tray 3*a* to a corresponding one of the four recording modules 50. Like the third image recording operation. The recording module control circuit 121 and the conveyance control circuit 122 then execute: the image recording processing for recording an image on the first surface of the sheet P based on the page data; the re-conveyance processing for conveying the sheet P again in order for the same recording module 50 to record the images respectively on the first surface and the second surface of the same sheet P; and the image recording processing for recording an image on the second surface of the sheet P based on the page data.

As in the second image recording operation, the recording module control circuit 121 and the conveyance control circuit 122 then execute the processing for discharging the sheet P discharged from each of the recording modules 50, onto the second output tray 4. In this fourth image recording operation, the sheet P is discharged onto the second output tray 4 in the state in which the second surface on which the image has been recorded based on the page data assigned with the lower page number faces downward. This configuration can collate the pages of the sheets P discharged on the specific output tray 11*a*, even in the case where the images are recorded respectively on both sides of the sheet P.

In the present embodiment as described above, the plurality of recording modules 50 are used for image recording on the sheets P, resulting in increase in speed of operations of the printer. Also, in the first image recording operation and the third image recording operation, the sheet P on which the entire image or all the images have been recorded by each of the recording modules 50 is turned upside down on the third conveyance path and then discharged onto a corresponding one of the first output trays 11 via the recording module 50, allowing the sheet P to be discharged onto the first output tray 11 in the state in which the surface on which the image has been just recorded faces downward. This configuration eliminates the need for the user to rearrange the image-recorded sheets P in the right page order, thereby reducing a load, of the user.

In addition, each sheet P can be selectively discharged onto one of the four first output trays 11 or the second output tray 4 based on the selected tray information, whereby the sheets P can be sorted into a plurality of groups.

In the above-described first image recording operation, the recording of the image on the sheet P based on the image data is performed by the recording modules 50 other than the second recording module 50*a* with a higher priority than by the second recording module 50*a*. Also, in the third image recording operation, the recording of the image on the sheet P based on the image data is performed only by the recording modules 50 other than the second recording module 50*a*. These configurations can reduce operations of stopping the re-conveyance of the sheet P to the second recording module 50*a* for image recording by the second recording module 50*a*, resulting in increase in speed of operations of the printer.

In image recording on both sides of the sheet P, the same recording module 50 records images respectively on the first surface and the second surface of the same sheet P, thereby simplifying the conveyance of the sheet P and the sorting of the page data by the sorting circuit 123.

In the first image recording operation for recording an image on only one side of the sheet P, the identification information is recorded on the surface of the sheet P which is a back side from the image-recorded surface, allowing the user to easily sort the sheets P discharged on the first output tray 11 into a plurality of groups. As a modification, the identification information may be recorded on the sheet P also in the second-fourth image recording operations. In this case, the identification information is recorded on a surface of the sheet P on which an image is recorded, and accordingly as illustrated in FIGS. 11A and 11B the identification information is preferably recorded on only an edge portion of the sheet P. In the third image recording operation and the fourth image recording operation for recording images respectively on both sides of the sheet P, the identification information may be recorded on the first surface, the identification information may be recorded on the second surface, and the identification information may be recorded on both of the first surface and the second surface.

Figure 13:
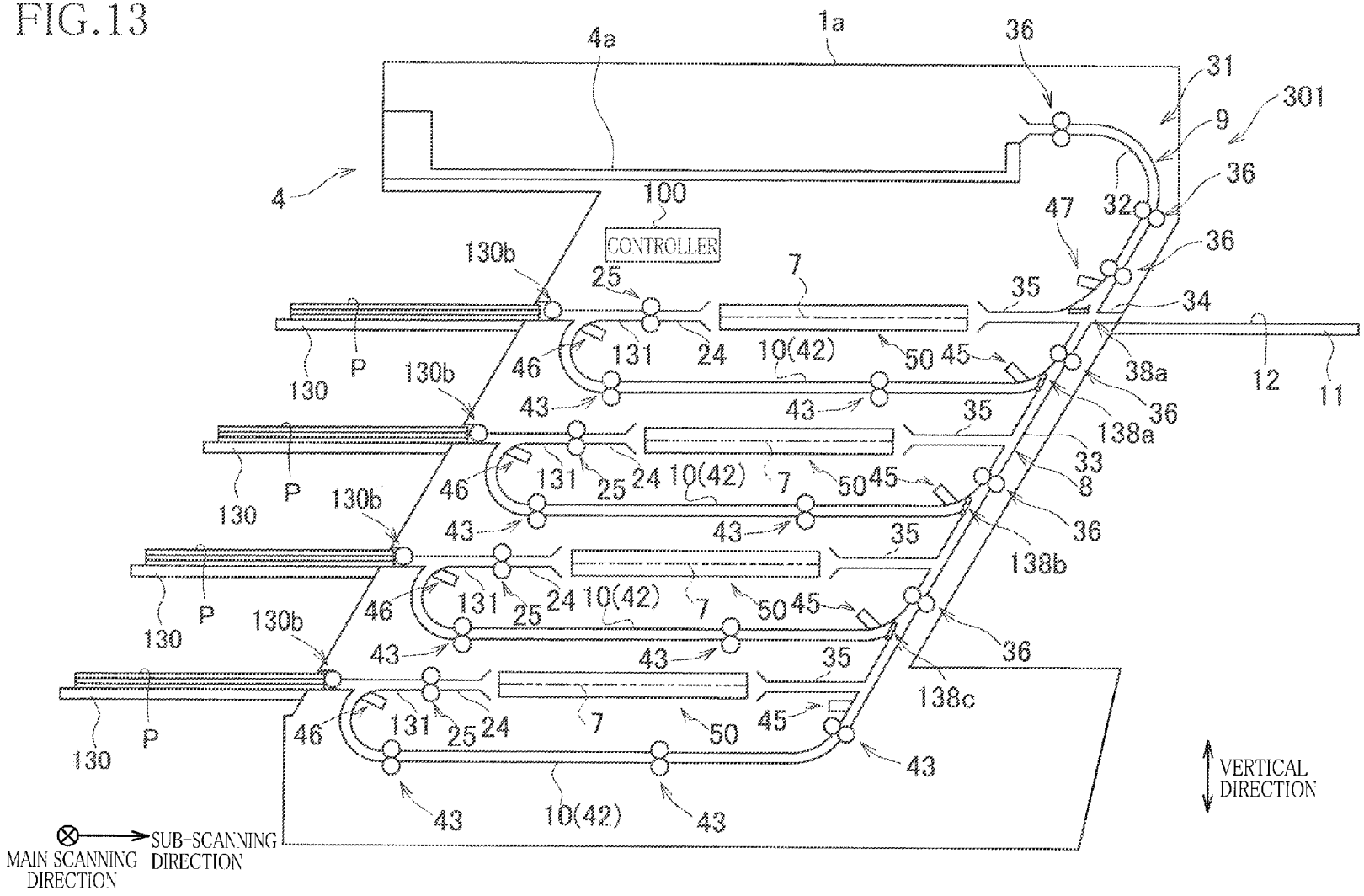
FIG. 13 is a schematic side view illustrating an internal structure of a printer according to a modification.

The present invention is applicable to a printer 301 illustrated in FIG. 13. This printer 301 does not include the sheet-supply tray 3*a* shared by the four recording modules 50 but is provided with four sheet-supply trays 130 respectively corresponding to the four recording modules 50. In this construction, each of the guides 24 and a corresponding one of guides 131 connecting between the respective guides 24 and the respective sheet-supply trays 130 define the second conveyance path. This printer 301 includes sheet-supply rollers 130*b* respectively for the sheet-supply trays 130. The controller 100 drives the sheet-supply motor to rotate each of the sheet-supply rollers 130*b* to supply an uppermost one of the sheets P stored on a corresponding one of the sheet-supply trays 130 to the second conveyance path. Thus, this printer 301 is configured such that the sheet P is supplied from each of the sheet-supply trays 130 to only a corresponding one of the recording modules 50.

The number of the first output trays 11 needs to be larger than or equal to one and smaller than or equal to the number of the recording modules 50. For example, as illustrated in FIG. 13, a single first output tray 11 may be provided without providing the four first output trays 11 respectively corresponding to the four recording modules 50. In the example illustrated in FIG. 13, the uppermost recording module 50 corresponds to the first recording modules.

As illustrated in FIG. 13, the printer may have four re-conveyance paths 10 respectively corresponding to the four recording modules 50. Each of the re-conveyance paths 10 connects between the downstream conveyance path 8 and the guide 24 continuous to the intermediate conveyance path 7 of a corresponding one of the recording modules 50. Three switching mechanisms 138*a*-138*c* are provided on the downstream conveyance path 8 to switch a destination of the sheet P conveyed on the downstream conveyance path 8, selectively to one of the four re-conveyance paths 10. In this modification, the three switching mechanisms 138*a*-138*c* constitute the second switcher capable of switching the destination of the sheet P conveyed to the downstream conveyance path 8 (i.e., the third conveyance path), selectively to one of the plurality of recording modules 50. In FIG. 13, illustrations of the recording modules 50 are simplified for easier understanding.

While the embodiment of the present invention has been described above, it is to be understood that the invention is not limited to the details of the illustrated embodiment, but may be embodied with various changes and modifications, which may occur to those skilled in the art, without departing from the spirit and scope of the invention. For example, the printer 1 may not include the second output tray 4.

In the above-described embodiment, the identification-information recording processing of the first image recording operation is executed such that the identification information is recorded on a surface of each of all the sheets P which is a back side from the image-recorded surface. However, the identification information may be recorded on only the last sheet P discharged onto the first output tray 11 among the plurality of sheets P on which images are respectively recorded based on the image data in this configuration, the user can recognize the plurality of sheets P discharged on the first output tray 11 by viewing the identification information recorded on the uppermost sheet P placed on the first output tray 11. The identification information is recorded on the surface of the sheet P which is a back side from the image-recorded surface in the first image recording operation in the above-described embodiment but may be recorded on the image-recorded surface.

The identification-information recording processing may not be executed in the first image recording operation. This configuration can also increase the average conveying speed of the sheet P when the last sheet P passes through the second recording module 50*a*. Also, as in the image recording processing, the head 51 may record the identification information on the sheet P while being reciprocated in the main scanning direction in the identification-information recording processing.

In the third image recording operation and the fourth image recording operation, the images may be recorded respectively on the first surface and the second surface of the same sheet P not by the same recording module 50 but by the different recording modules 50.

The number of the recording modules 50 is not limited to four and may be two or more. It is noted that the number of the recording modules 50 is preferably larger or equal to three in order to reduce the operations for stopping the re-conveyance of the sheet P to the second recording module 50*a* and achieve the printer with increased speed of operations.

Also in the first image recording operation and the third image recording operation, the image recording on the sheets P may not be performed by the recording modules 50 other than the second recording module 50*a* with a higher priority. That is, the number of the sheets P for which image recording is performed may be generally the same among the recording modules 50, in the case where images are recorded respectively on both sides of the sheet P by the second recording module 50*a* in the third image recording operation, each sheet P whose second surface has been printed by the second recording module 50*a* may be directly discharged onto the specific output tray 11*a* a via the fourth conveyance path without being conveyed to the third conveyance path. To discharge the sheets P onto the specific output tray 11*a* in the right page order in this configuration, the image based on the page data assigned with the lower page number is recorded on the first surface by the second recording module 50*a* unlike the other recording modules 50, and the image based on the page data assigned with the higher page number is recorded on the second surface of the sheet P in the image recording performed later.

While the third conveyance path, the at least one fourth conveyance path, and the shared output path share the downstream first paths 8*a* in the above-described embodiment, the third conveyance path, the at least one fourth conveyance path, and the shared output path may not have any shared conveyance path. Likewise, the third conveyance path and the shared output path share the downstream second path 8*b*, but the third conveyance path and the shared output path may not have any shared conveyance path. That is, the third conveyance path, the at least one fourth conveyance path, and the shared output path may individually extend from the downstream ends of the intermediate conveyance paths 7 of the respective recording modules 50.

While the page data storages 114 are included in the RAM 93 of the controller 100 in the above-described embodiment, each of the recording modules 50 may include a memory which includes the page data storages 114.

The present invention is applicable to a printer including a line head. Also, the present invention is applicable not only to the printer but also to various devices such as a facsimile machine and a copying machine. Also, the present invention is applicable various kinds of recording apparatuses such as a laser recording apparatus and a thermal recording apparatus as long as each recording apparatus is configured to perform image recording. The recording medium is not limited to the sheet P and may be various kinds of recording media. While the conveying roller pairs 52-54 are driven by the respective different motors in the above-described embodiment but may be driven by the same drive source. In this configuration, in a case where each of the conveying roller pairs 53, 54 is provided as a one-way roller, and rotational power of the conveying roller pair 52 is transmitted to the conveying roller pairs 53, 54, but rotational power of the conveying roller pairs 53, 54 is not transmitted to the conveying roller pair 52, the image-recorded sheets can be conveyed successively by successive drivings of the conveying roller pairs 36 and the conveying roller pairs 53, 54 while the recording module can start a processing for the next sheet by independent (intermittent) driving of the conveying roller pair 52, thereby improving a throughput.

The switchers 27*a*1-27*c*1 of the respective three switching mechanisms 27*a*-27*c* of the upstream guide unit 21 are driven by the respective different switching motors in the above-described embodiment but may be driven by the same drive source. The switchers 38*a*1-38*d*1 of the respective four switching mechanisms 38*a*-38*d* of the downstream guide unit 31 are driven by the respective different switching motors in the above-described embodiment but may be driven by the same drive source.

The four recording modules 50 are respectively arranged at different positions in the sub-scanning direction in the above-described embodiment, but may be arranged at the same position. Also, adjacent two of the recording modules 50 may be arranged at different positions in a direction which coincides with a direction on a plane of a conveying surface on which the sheet P is conveyed on the intermediate conveyance path 7 and with a direction different from the sub-scanning direction (e.g., the main scanning direction). The sheet-supply unit 3 and the second output tray 4 may be arranged so as not to overlap any of the recording modules 50 in the vertical direction. The upstream first path 6*a* of the second conveyance path and the first conveyance path (i.e., the intermediate conveyance path 7) intersect each other obliquely in the above-described embodiment but may be arranged so as to be perpendicular to each other. While the downstream second path 8*b* of the third conveyance path and the first conveyance path (i.e., the intermediate conveyance path 7) intersect each other obliquely in the above-described embodiment but may be arranged so as to be perpendicular to each other. The upstream first path 6*a* and the downstream second path 8*b* may be inclined at the same angle and may be inclined at different angles. The support surfaces 12 of the respective first output trays 11 may be inclined with respect to a horizontal direction. While the four recording modules 50 have the same structure in the above-described embodiment, the plurality of recording modules may be different from each other in, e.g., recordable color, resolution, recording speed (i.e., printing speed), recording method (i.e., printing method), type of recordable recording medium, and recordable size.

As the image recording operation for image recording on both sides of the sheet P, unlike the third image recording operation in which each sheet P whose second surface has been printed by each of the recording modules 50 (i.e., each sheet P having the image-recorded first and second surfaces) is conveyed again to the second output tray 4, a fifth image recording operation may be executed in which each sheet P is directly discharged onto a corresponding one of the first output trays 11 via a corresponding one of the at least one fourth conveyance path. In this fifth image recording operation, each sheet P whose second surface has been printed by an Xth recording module 50 from the top (X=1, 2, . . . ) is directly discharged onto an Xth first output tray 11 from the top via a corresponding one of the at least one fourth conveyance path. Accordingly, an operation different from the above-described third image recording operation needs to be performed to collate the pages. That is, among the page data corresponding to the two pages to be recorded on the first surface and the second surface of the same sheet P, the image based on the page data assigned with the lower page number needs to be recorded on the first surface, and the image based on the page data assigned with the higher page number needs to be recorded on the second surface in the image recording performed later.

What is claimed is:

1. A recording apparatus, comprising:

an image-data storage configured to store image data;

a plurality of recording modules each comprising:

a first conveyor configured to convey a recording medium along a first conveyance path; and a recording device configured to record an image on an upper surface of the recording medium;

a storage tray configured to store a recording medium;

a plurality of first output trays each configured to support a recording medium discharged from a corresponding one of at least one first recording module of the plurality of recording modules;

a second conveyance path connecting between the storage tray and one end portion of the first conveyance path for each of the plurality of recording modules;

a third conveyance path configured to connect between the second conveyance path and another end portion of the first conveyance path for each of the plurality of recording modules;

a plurality of fourth conveyance paths each connecting between said another end portion of the first conveyance path for a corresponding one of the plurality of first recording modules and a corresponding one of the plurality of first output trays;

a second conveyor configured to convey the recording medium along the second conveyance path;

a first switcher configured to selectively switch a destination of conveyance of the recording medium conveyed to said another end portion of the first conveyance path, to any one of the third conveyance path and the plurality of fourth conveyance paths;

a second switcher configured to selectively switch a destination of conveyance of the recording medium conveyed to the second conveyance path, to any one of the plurality of recording modules;

a third conveyor configured to convey the recording medium along the third conveyance path; and a controller configured to control the plurality of recording modules, the first conveyor, the second conveyor, the third conveyor, the first switcher, and the second switcher to perform:

a supplying processing in which one recording medium to be discharged onto a specific first output tray that is one of the plurality of first output trays is supplied to at least one first recording module of the plurality of recording modules, the at least one first recording module being at least one recording module other than a specific recording module among the plurality of recording modules, the specific recording module corresponding to the specific output trays;

a recording process in which all of at least one image to be recorded on only a first surface or both of the first surface and a second surface of the one recording medium is recorded by the recording device of the at least one first recording module, the second surface being a back surface of the first surface;

a re-conveying processing, in response to a completion of the recording processing, in which the one recording medium is conveyed from the first conveyance path via the third conveyance path, the second conveyance path, the specific recording module in this order; and a discharging processing in which the one recording medium is discharged from the specific recording module onto the specific first output tray via a corresponding one of the plurality of fourth conveyance paths.

2. The recording apparatus according to claim 1, comprising:

at least three recording modules as the plurality of recording modules.

3. The recording apparatus according to claim 1;

wherein the controller is configured to, when images, as the at least one image, corresponding to two consecutive pages are recorded respectively on both of the first surface and the second surface of the one recording medium based on the image data, control the plurality of recording modules, the second conveyor, the third conveyor, the first switcher, and the second switcher to perform:

the recording processing in which:

a first image corresponding to a following page of the two consecutive pages is recorded on the first surface of the one recording medium based on the image data by the at least one first recording module;

the one recording medium for which the first image has been recorded on the first surface is re-conveyed, to the at least one first recording module, via the third conveyance path, the second conveyance path, and the first conveyance path in this order; and a second image corresponding to a previous page of the two consecutive pages is recorded on the second surface of the one recording medium based on the image data by the at least one first recording module;

the re-conveying processing in which, in response to a completion of the recording of the second surface, the one recording medium is re-conveyed to the specific recording module via the third conveyance path; and the discharging processing in which the one recording medium is discharged onto the specific first output tray via the corresponding one of the plurality of fourth conveyance paths.

4. The recording apparatus according to claim 1;

wherein the controller is configured to, when the at least one image is recorded on only the first surface in the one recording medium based on the image data, control the plurality of recording modules and the first conveyor to perform:

the recording processing in which a first image corresponding to the first surface is recorded on the first surface of the one recording medium is recorded based on the image data by the at least one first recording module;

the re-conveying processing in which, in response to a completion of the recording of the first surface, the one recording medium is re-conveyed to the specific first recording module via the third conveyance path; and the discharging processing in which the one recording medium is discharged onto the specific first output tray.

5. The recording apparatus according to claim 4, further comprising:

an identification information storage configured to store identification information relating to the image data;

wherein the controller is configured to further perform a identifying processing in which, in response to a completion of the re-conveying processing, an identification indication is recorded on one of the first surface and the second surface of the one recording medium by the specific recording module based on the identification information stored in the identification information storage; and wherein the controller is configured to perform the discharging processing in which the one recording medium on which the identification indication is recorded is discharged onto the specific first output tray.

6. The recording apparatus according to claim 5, further comprising:

a receiver configured to receive, from an external device, a recording command for recording an image on the recording medium based on the image data, wherein the identification indication is an identifier for identifying a device having transmitted the recording command.

7. The recording apparatus according to claim 5;

wherein the identification indication is an identifier for identifying the image data.

8. The recording apparatus according to claim 5;

wherein the controller is configured to control the plurality of recording modules to record the identification indication on an edge portion of the second surface of the recording medium.

9. The recording apparatus according to claim 5;

wherein an average conveying speed at which the one recording medium passes through the first conveyance path of the at least one first recording module when the identification indication is recorded on the second surface of the one recording medium is greater than an average speed at which the one recording medium passed through the first conveyance path of the at least one first recording module when the image is recorded on the first surface.

10. The recording apparatus according to claim 1, further comprising:

a second output tray;

a shared output path connecting between the second output tray and said another end portion of the first conveyance path for each of the plurality of recording modules; and a third switcher configured to selectively switch a destination of conveyance of the recording medium conveyed to said another end portion of the first conveyance path for each of the plurality of recording modules, to any one of the third conveyance path and the second output tray;

wherein the controller is configured to control the plurality of recording modules, the second conveyor, the third conveyor, the first switcher, the second switcher, and the third switcher to perform:

when one of the plurality of first output trays as the specific output tray is specified as the destination of discharge, the discharging processing in which the one recording medium on which all of the at least one image to be recorded on the one recording medium has been recorded in the recording processing and has been re-conveyed in the re-conveying processing is discharged, onto the specific first output tray via the corresponding one of the plurality of fourth conveyance paths; and when the second output tray is specified as the destination of discharge by the second specifying device, in response to the completion of the recording processing, the discharging processing in which the one recording medium is discharged onto, in the place of the specific first output tray, the second output tray via the shared output path without performing the re-conveying processing.

11. A non-transitory storage medium storing a plurality of instructions executable by a processor of a recording apparatus;

the recording apparatus comprising:

an image-data storage configured to store image data;

a plurality of recording modules each comprising:

a first conveyor configured to convey a recording medium along a first conveyance path; and a recording device configured to record an image on an upper surface of the recording medium;

a storage tray configured to store a recording medium;

a plurality of first output trays each configured to support a recording medium discharged from a corresponding one of at least one first recording module of the plurality of recording modules;

a second conveyance path connecting between the storage tray and one end portion of the first conveyance path for each of the plurality of recording modules;

a third conveyance path configured to connect between the second conveyance path and another end portion of the first conveyance path for each of the plurality of recording modules;

a plurality of fourth conveyance paths each connecting between said another end portion of the first conveyance path for a corresponding one of the plurality of first recording modules and a corresponding one of the at plurality of first output trays;

a second conveyor configured to convey the recording medium along the second conveyance path;

a first switcher configured to selectively switch a destination of conveyance of the recording medium conveyed to said another end portion of the first conveyance path, to any one of the third conveyance path and the plurality of fourth conveyance paths; and a second switcher configured to selectively switch a destination of conveyance of the recording medium conveyed to the second conveyance path, to any one of the plurality of recording modules;

a third conveyor configured to convey the recording medium along the third conveyance path;

the plurality of instructions, when executed by the processor, causing the recording apparatus to control the plurality of recording modules, the first conveyor, the second conveyor, the third conveyor, the first switcher, and the second switcher to perform:

a supplying processing in which one recording medium to be discharged onto a specific first output tray that is one of the plurality of first output trays is supplied to at least one first recording module of the plurality of recording modules, the at least one first recording module being at least one recording module other than a specific recording module among the plurality of recording modules, the specific recording module corresponding to the specific output trays;

a recording processing in which all of at least one image to be recorded on only a first surface or both of the first surface and a second surface of the one recording medium is recorded by the recording device of the at least one first recording module, the second surface being a back surface of the first surface;

a re-conveying processing, in response to a completion of the recording processing, in which the one recording medium is conveyed from the first conveyance path via the third conveyance path, the second conveyance path, the specific recording module in this order; and a discharging processing in which the one recording medium is discharged from the specific recording module onto the specific first output tray via a corresponding one of the plurality of fourth conveyance paths.

* * * * *